US007904005B2

(12) United States Patent
Hattori et al.

(10) Patent No.: US 7,904,005 B2
(45) Date of Patent: Mar. 8, 2011

(54) IMAGE FORMING APPARATUS

(75) Inventors: Ryuji Hattori, Kanagawa (JP); Atsushi Funada, Kanagawa (JP); Hiroaki Okuma, Kanagawa (JP); Junichi Hama, Kanagawa (JP); Hirokazu Murase, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 12 days.

(21) Appl. No.: 12/549,069

(22) Filed: Aug. 27, 2009

(65) Prior Publication Data

US 2010/0221045 A1 Sep. 2, 2010

(30) Foreign Application Priority Data

Feb. 26, 2009 (JP) ..... P2009-044616
Mar. 19, 2009 (JP) ..... P2009-068904
Mar. 19, 2009 (JP) ..... P2009-068919
Mar. 19, 2009 (JP) ..... P2009-068938

(51) Int. Cl.
*G03G 15/08* (2006.01)

(52) U.S. Cl. ..... 399/258; 399/107; 399/262

(58) Field of Classification Search ..... 222/DIG. 1; 399/107, 258, 260, 262
See application file for complete search history.

(56) References Cited

U.S. PATENT DOCUMENTS 5,455,662 A 10/1995 Ichikawa et al. ..... 355/260
5,500,719 A 3/1996 Ichikawa et al. ..... 355/260
5,627,631 A 5/1997 Ichikawa et al. ..... 355/260
5,737,675 A * 4/1998 Okada et al. ..... 399/258
5,822,663 A 10/1998 Ichikawa et al. ..... 399/262
5,867,757 A 2/1999 Okazaki et al. ..... 399/262
5,918,090 A 6/1999 Ichikawa et al. ..... 399/120
6,075,963 A 6/2000 Ichikawa et al. ..... 399/262
6,289,195 B1 9/2001 Ichikawa et al. ..... 399/262
6,418,293 B2 7/2002 Ichikawa et al. ..... 399/262
6,438,342 B2 * 8/2002 Hatano ..... 399/117
6,751,431 B2 6/2004 Ichikawa et al. ..... 399/262
6,901,230 B2 5/2005 Ichikawa et al. ..... 399/262
7,352,975 B2 * 4/2008 Fujiwara et al. ..... 399/12

FOREIGN PATENT DOCUMENTS

JP 10-213959 8/1998
JP 11-143190 5/1999
JP 2000-275946 10/2000

(Continued)

*Primary Examiner*—Hoang Ngo
(74) *Attorney, Agent, or Firm*—Morgan, Lewis & Bockius LLP

(57) ABSTRACT

An image forming apparatus includes: an image forming apparatus body that includes a container attaching portion to which a developer container is removably attached; a container put-on member on which the developer container is put; and a support member to which the container put-on member is attached, the support member supporting the container put-on member to perform a movement between a first position in which the container put-on member is at the container attaching portion and a second position in which the container put-on member is pulled out from the container attaching portion, wherein at the second position, at least a part of the container put-on member is displaced downward through a rotating shaft provided on the support member to a lower position than a height of the container put-on member at the second position in the direction of gravity.

14 Claims, 21 Drawing Sheets

FOREIGN PATENT DOCUMENTS

| | | |
|---|---|---|
| JP | 2003-066705 | 3/2003 |
| JP | 2003-114568 | 4/2003 |
| JP | 2003-295591 | 10/2003 |
| JP | 2002-351203 | 12/2003 |
| JP | 2004-126407 | 4/2004 |
| JP | 2006-078627 | 3/2006 |
| JP | 2006-215239 | 8/2006 |
| JP | 3952705 | 5/2007 |

* cited by examiner

IMAGE FORMING APPARATUS

CROSS-REFERENCE TO RELATED APPLICATION

This application is based on and claims priority under 35 USC 119 from Japanese Patent Application Nos. 2009-044616 filed Feb. 26, 2009 and 2009-068904, 2009-068919 and 2009-068938 each filed Mar. 19, 2009.

BACKGROUND

1. Technical Field

The present invention relates to an image forming apparatus.

2. Related Art

In some image forming apparatuses, for example, a printer, a copying machine or a facsimile which applies a recording method such as an electrophotographic method or an ink jet method, a developer container for accommodating a developer such as a toner or an ink which constitutes an image is removably attached to an attaching portion of an image forming apparatus body and is thus used, for instance.

SUMMARY

According to an aspect of the invention, there is provided an image forming apparatus, including:

an image forming apparatus body that includes a container attaching portion to which a developer container for containing a developer is removably attached;

a container put-en member on which the developer container is put; and a support member to which the container put-on member is attached, the support member supporting the container put-on member to perform a movement between a first position in which the container put-on member is at the container attaching portion and is thus stored and a second position in which the container put-on member is pulled out from the container attaching portion to an outside of the image forming apparatus body, wherein at the second position, at least a part of the container put-on member is displaced downward through a rotating shaft provided on the support member to a lower position than a height of the container put-on member at the second position in the direction of gravity.

BRIEF DESCRIPTION OF THE DRAWINGS

Exemplary embodiments of the present invention will be described in detail based on the following figures, wherein:

(FIG. 3A illustrates a state in which a cartridge receiving table is shifted to a pull-out completing position and FIG. 3B illustrates a state in which the cartridge receiving table is shifted to a put-on and down position);

(FIG. 13A illustrates a state in which the cartridge receiving table is shifted to the pull-out completing position and FIG. 13B illustrates a state in which the cartridge receiving table is shifted to the put-on and down position);

DETAILED DESCRIPTION

An exemplary embodiment according to the invention will be described below with reference to the accompanying drawings.

Figure 1:
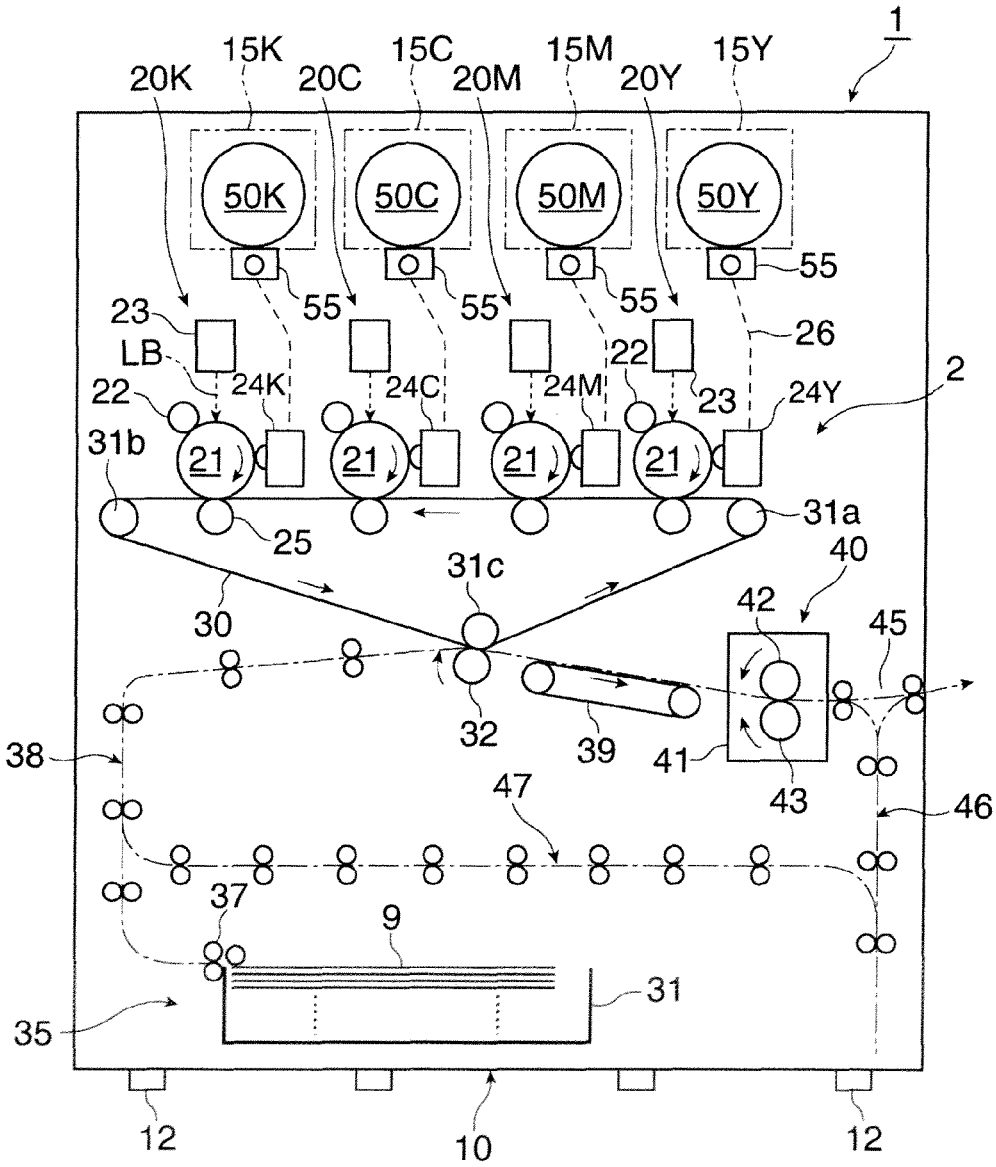
FIG. 1 is an explanatory view showing an outline of an image forming apparatus (a structure of an inner part of a housing seen from a front side) according to an exemplary embodiment.
Figure 2:
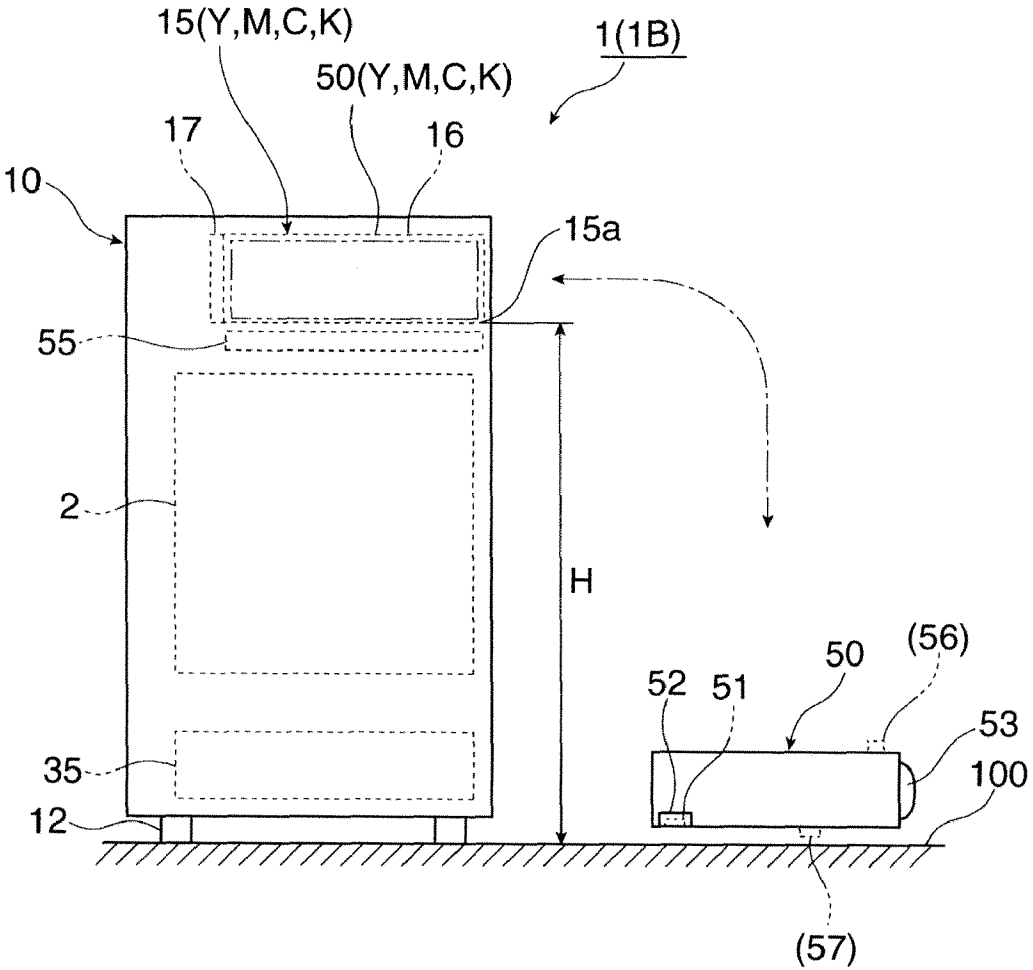
FIG. 2 is an explanatory view showing a state (structure) seen from a side surface side of the image forming apparatus in FIG. 1.

FIG. 1 shows an outline seen from a front side of an image forming apparatus 1 according to the exemplary embodiment and FIG. 2 shows a state seen from a side surface side of the image forming apparatus 1.

In the image forming apparatus 1 shown in FIG. 1, an imaging device 2 for forming a toner image constituted by a dry toner (powder) as a developer by utilizing a publicly-known electrophotographic method is provided in an internal space of a housing 10 (image forming apparatus body) constituted by a support member or an outer cover. The reference numeral 12 in FIG. 1 denotes a moving type support leg provided in a bottom part of the housing 10, and the reference numeral 100 denotes an installing surface of a place in which the image forming apparatus 1 is installed.

The imaging device 2 according to the exemplary embodiment employs an intermediate transfer method using an intermediate transfer member 30 taking a shape of a belt and has a structure in which a plural imaging units 20Y, 20M, 20C and 20K for forming toner images having different colors from each other (for example, yellow: Y, magenta: M, cyan: C, black: K) is arranged in a rotating direction of the intermediate transfer member 30. Moreover, the imaging device 2 can form an image having a single color or an image having a multicolor which is constituted by a toner through a selection and use of the imaging units 20.

Each of the imaging units 20 in the imaging device 2 rotates a drum-shaped photosensitive member 21 in a direction shown in an arrow (a clockwise direction in an exemplary example shown in FIG. 1) and charges a peripheral surface to be an image forming region of the photosensitive member 21 into a predetermined potential by a charging device 22, and then irradiates a light (LB) based on image information (a signal) through an exposing device 23 onto the peripheral surface of the photosensitive drum 21 thus charged, thereby forming an electrostatic latent image having a predetermined latent image potential. Subsequently, each of the imaging units 20 develops an electrostatic latent image having each color component formed on each of the photosensitive members 21 through a toner having a predetermined color which is supplied from a developing device 24 and forms a toner image, and then transfers the toner image onto the belt-shaped intermediate transfer member 30 rotated and moved in contact with the photosensitive member 21 through a primary transfer device 25.

In the imaging device 2, the toner image having each color component which is formed on the photosensitive member 21 of each imaging unit 20 at the image forming step is transferred onto the intermediate transfer member 30. In the case in which a plural toner images is combined to form an image having a multicolor, the toner image having the predetermined color component which is formed on the photosensitive member 21 of the corresponding imaging unit 20 is transferred in a state in which they are aligned with each other with respect to the intermediate transfer member 30. At the image forming step, a charging voltage, a developing voltage or a primary transferring voltage is applied from a power supply (not shown) to the charging device 22, the developing device 24 and the primary transfer device 25. Referring to the photosensitive member 21 after the end of the transfer, moreover, the toner remaining on the peripheral surface is removed by a cleaning device which is not shown.

Next, the imaging device 2 transfers, through a secondary transfer device 32, the toner image transferred to the intermediate transfer member 30 onto a paper 9 delivered by a paper supplying device 35 toward a secondary transfer position between the secondary transfer device 32 of a roll type and the intermediate transfer member 30.

The belt-shaped intermediate transfer member 30 is disposed in a state in which it is positioned on a lower side of each of the imaging units 20 in the imaging device 2, and specifically, is provided over a plural belt support rolls 31*a* to 31*c* and is rotated in a direction shown in an arrow (a counterclockwise direction in the example illustrated in FIG. 1). The support roll 31*a* is a driving roll and the support roll 31*c* is a secondary transfer back-up roll which is grounded. A secondary transferring voltage is applied from a power supply (not shown) to a secondary transfer roll of the secondary transfer device 32 at a secondary transferring step. The paper supplying device 35 feeds the papers 9 accommodated in a stacking state on a paper housing 36 and having desirable sizes and types one by one through a paper transmitting device 37. The paper 9 fed from the paper supplying device 35 in a predetermined timing is delivered through a feeding paper delivering path 38 constituted by a plural delivery roll pairs and a delivery guide member which are provided between the paper supplying device 35 and the secondary transfer device 32.

Subsequently, the imaging device 2 feeds the paper 9 having the toner image transferred at the secondary transferring step to a fixing device 40 and fixes the toner image onto the paper 9. A paper transporting device 39 belt type which serves to transport the transferred paper 9 is provided between the secondary transferring device 32 and the fixing device 40.

The fixing device 40 is constituted to include, in a housing 41, a heating rotor 42 having a roll configuration or a belt configuration which is rotated and driven in a direction shown in an arrow and in which a surface temperature is heated and held to a predetermined temperature by heater, and a pressurizing rotor 43 having a roll configuration or a belt configuration which is driven and rotated in contact at a predetermined pressure almost in an axial direction of the heating rotor 42. In the fixing device 40, the paper 9 having the toner image transferred thereto is heated and pressurized in a passage through a contact part between the heating rotor 42 and the pressurizing rotor 43 so that the toner image is molten and is fixed onto the paper 9.

In the imaging device 2, then, the paper 9 subjected to the fixation is discharged from the fixing device 40 and is then delivered to a paper output housing portion (not shown) via an output paper delivering path 45. In the case in which an image is formed on both sides of the paper 9, moreover, the paper 9 having the toner image transferred and fixed to one of the sides is discharged from the fixing device 40 and is then fed into an inverting paper delivering path 46, and furthermore, is fed to meet the paper delivering path 38 via a retransmitting paper delivering path 47 provided in a connecting state between the inverting paper delivering path 46 and the feeding paper delivering path 38, and is finally delivered to the secondary transfer position in a timing for transferring the toner image onto the other side.

Moreover, the imaging device 2 uses the developing device 24 in each of the imaging units 20Y, 20M, 20C and 20K which utilizes a developer containing a toner and a carrier, and furthermore, has such a structure as to supply a new developer from toner cartridges 50Y, 50M, 50C and 50K (developer containers) which individually accommodate the toners having the color components of Y, M, C and K to developing devices 24Y, 24M, 24C and 24K if necessary as shown in FIG. 1. An operation for supplying the developer from each of the toner cartridges 50 is carried out by a supplying device 55 for connecting each of the toner cartridges 50 and each of the developing devices 24. In some cases, the developer accommodated in the toner cartridge 50 contains a toner and a carrier in addition to the case in which only the toner is contained. The reference numeral 26 shown in a dotted line of FIG. 1 denotes a developer feeding path provided between the supplying devices 55 and the developing devices 20 and serving to deliver a supply developer respectively.

A container taking a cylindrical shape having both ends closed is used for the toner cartridge 50. Moreover, the toner cartridge 50 has a toner discharging port 51 for discharging a toner which is provided in a part to be a bottom portion (a bottom portion to be an inner side in an attachment) when it is normally attached to a cartridge attaching portion 15 (container attaching portion), and has a slide type opening cover 52 attached thereto. The slide type opening cover 52 can be moved in a circumferential direction of the cartridge 50 between a position in which the toner discharging port 51 is closed and a position in which it is opened. Furthermore, the toner cartridge 50 has a handle portion 53 provided on an end face at one end side in a longitudinal direction of the cylindrical shape (an end side to be this side in the attachment). The handle portion 53 is used when the whole cartridge 50 attached to the cartridge attaching portion 15 is to be rotated at a predetermined angle in the circumferential direction to move the opening cover 52 to the closing position or the opening position, for example.

In the image forming apparatus 1, the cartridge attaching portion 15 for removably attaching the toner cartridge 50 is provided in an upper part of the imaging device 2 (each imaging unit 20) in the internal space of the housing 10 as shown in FIGS. 1 and 2.

Figure 3A:
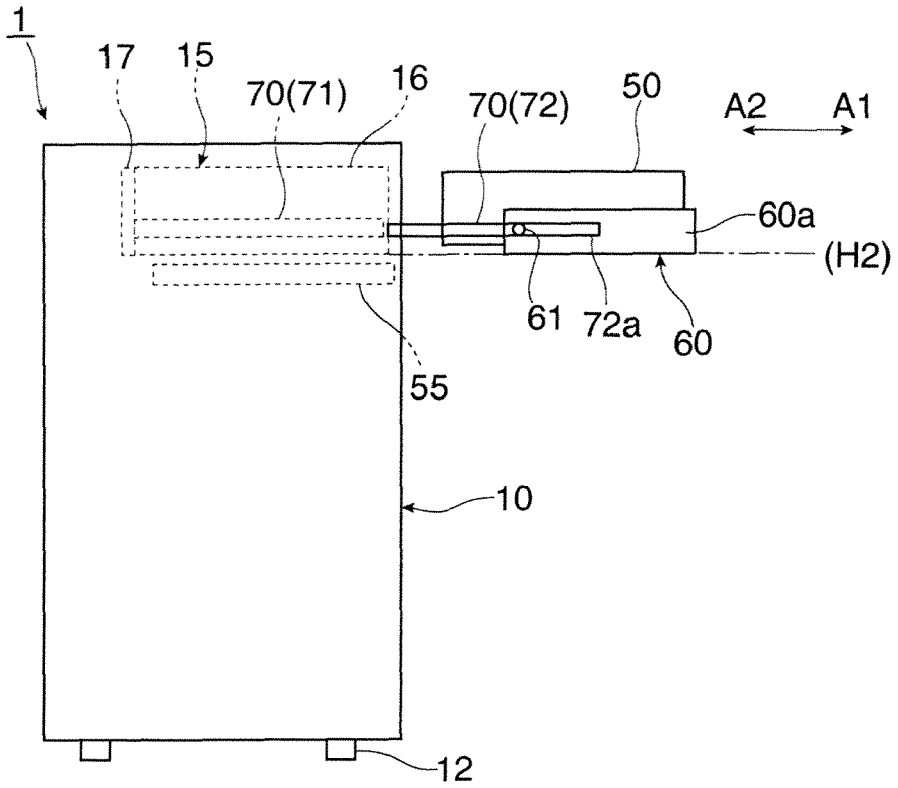
FIGS. 3A and 3B are explanatory views showing states related to a structure of a main part (a cartridge attaching portion) of the image forming apparatus in FIG. 2

As shown in FIGS. 3A to 8, the cartridge attaching portion 15 includes a housing frame portion 16 for maintaining a space to accommodate the whole toner cartridge 50, a cartridge put-on member 60 disposed in a lower part of the housing frame portion 16 and serving to put and hold the toner cartridge 50 thereon, a slide rail 70 (support member) for supporting the cartridge put-on member 60 to be rectilinearly moved between a position in which the cartridge put-on member 60 is stored in the cartridge attaching portion 15 (a storing position: a position in which the put-on member 60 is set into the state shown in FIG. 1) and a position in which the put-on member 60 is pulled out of the housing 10 from the attaching portion 15 (a pull-out completing position: a position in which the put-on member 60 is set into a state shown in FIG. 3A), and a drive transmitting portion 17 coupled to a toner delivering member which is provided rotatably in the toner cartridge 50 and serving to transmit a rotating power. An attaching port of the cartridge attaching portion 15 (an inlet of the housing frame portion 16) is opened and closed by means of an opening door (not shown) provided in the housing 10.

Figure 4:
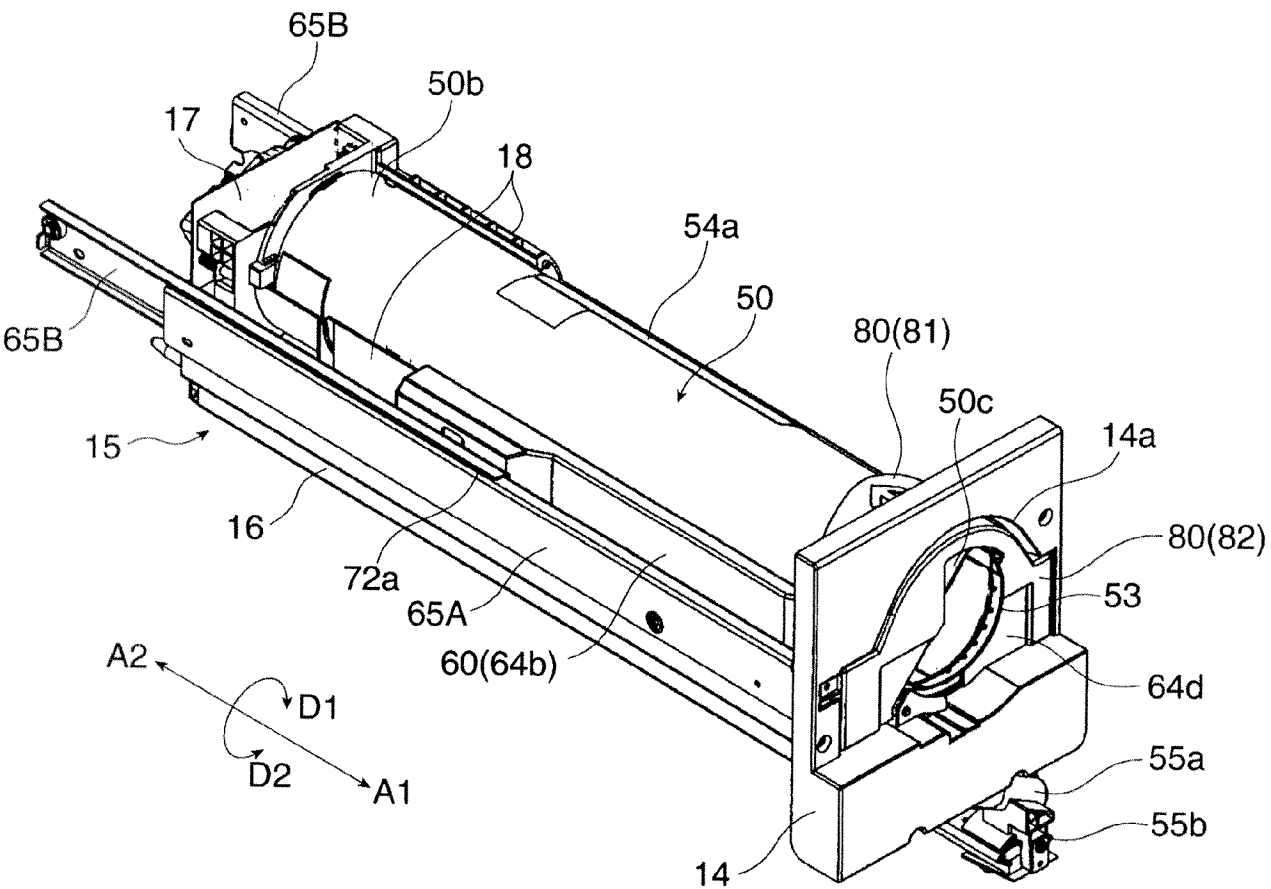
FIG. 4 is a perspective view showing a cartridge attaching portion (including an attached toner cartridge) in FIG. 2.

The reference numeral 14 in FIG. 4 denotes a front frame member having an attaching through-hole 14*a* for causing the toner cartridge 50 to pass therethrough in an attachment thereof and provided in the opening (the inlet) of the housing frame portion 16. Moreover, the reference numeral 55*a* denotes a developer delivering tube in the supplying device 55, the reference numeral 55*b* denotes a connecting portion for connecting the developer delivering tube 55*a* to a developer feeding path 26, and the reference numeral 54 denotes an information displaying portion constituted by a label attached to an outer peripheral surface of the toner cartridge 50. The reference numeral 18 in FIG. 5 denotes a toner cartridge holding frame provided between the housing frame portion 16 and the drive transmitting portion 17 and having a shape for holding the cartridge 50, and the reference numeral 19 denotes a toner intake for taking a toner discharged from the discharging port 51 of the toner cartridge 50 therein. The toner intake 19 is connected to one of ends of the developer delivering tube 55*a* in the supplying device 55.

Furthermore, the cartridge attaching portion 15 is provided in a high position to be an upper part of the housing 10 as shown in FIG. 2. For this reason, the cartridge attaching portion 15 has the cartridge put-on member 60 attached thereto as will be described below in order to reduce a burden of a toner cartridge attaching work to be increased with an increase in a height (H) of the attaching portion 15 (particularly, a work for putting the cartridge 50 on the cartridge put-on member 60 and a work for putting the cartridge 50 down from the put-on member 60). The designation H in FIG. 2 denotes a height in a lowermost attaching portion 15*a* of the cartridge attaching portion 15 from the installation surface 100 in a place in which the image forming apparatus 1 is to be provided. The height H corresponds to a height of the cartridge attaching portion 15.

Figure 3B:
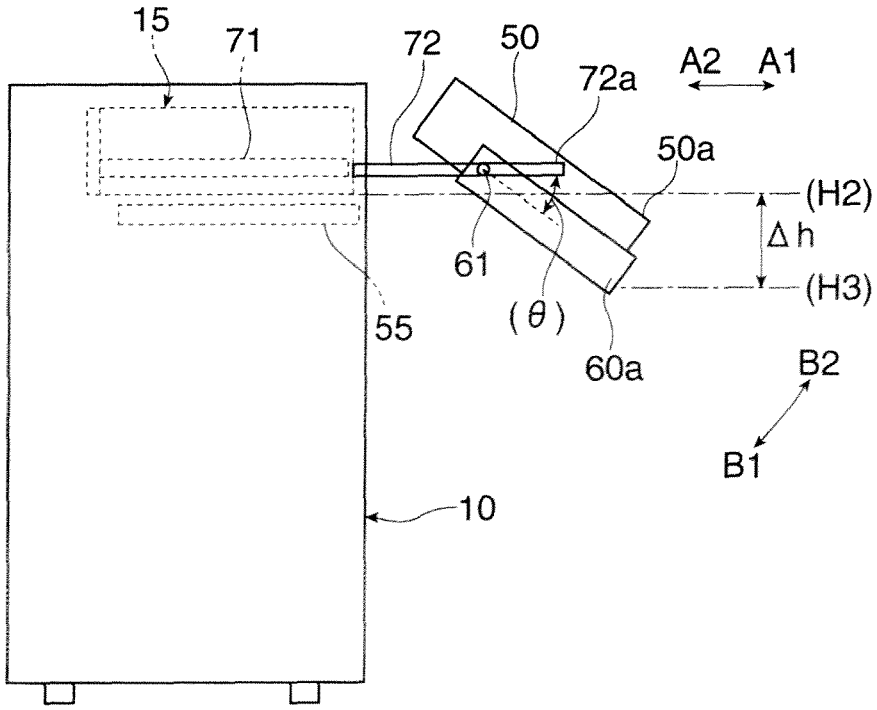

As shown in FIGS. 3A and 3B, the cartridge put-on member 60 is rockably attached to a predetermined portion of the slide rail 70 through a rotating shaft 61 in such a manner that one end 60*a* to be a downstream side in a pull-out direction A1 of the put-on member 60 is shifted to a cartridge put-on and down position (a position in which the put-on member 60 is set into a state shown in FIG. 3B) to be a lower position of H3 (<H2) than a height in a pull-out completing position (pull-out position) of H2 (a height from the installation surface 100). The designation Δh in FIG. 3B denotes a maximum height difference between the height of the pull-cut completing position of H2 and the height of the cartridge put-on and down position of H3.

In the slide rail 70, a basic structure portion thereof is formed by that of a well-known slide rail. In the embodiment, there is used the slide rail 70 of such a type as to be constituted by a pair of cuter (fixed) rails 71 attached to the housing frame portion 16 of the cartridge attaching portion 15 (a part of the housing 10 may be utilized) in an opposite fixing state at an interval, and a pair of inner (movable) rails 72 attached to an inside of the outer fail 71 so as to enable a rectilinear movement in a longitudinal direction.

Figure 5:
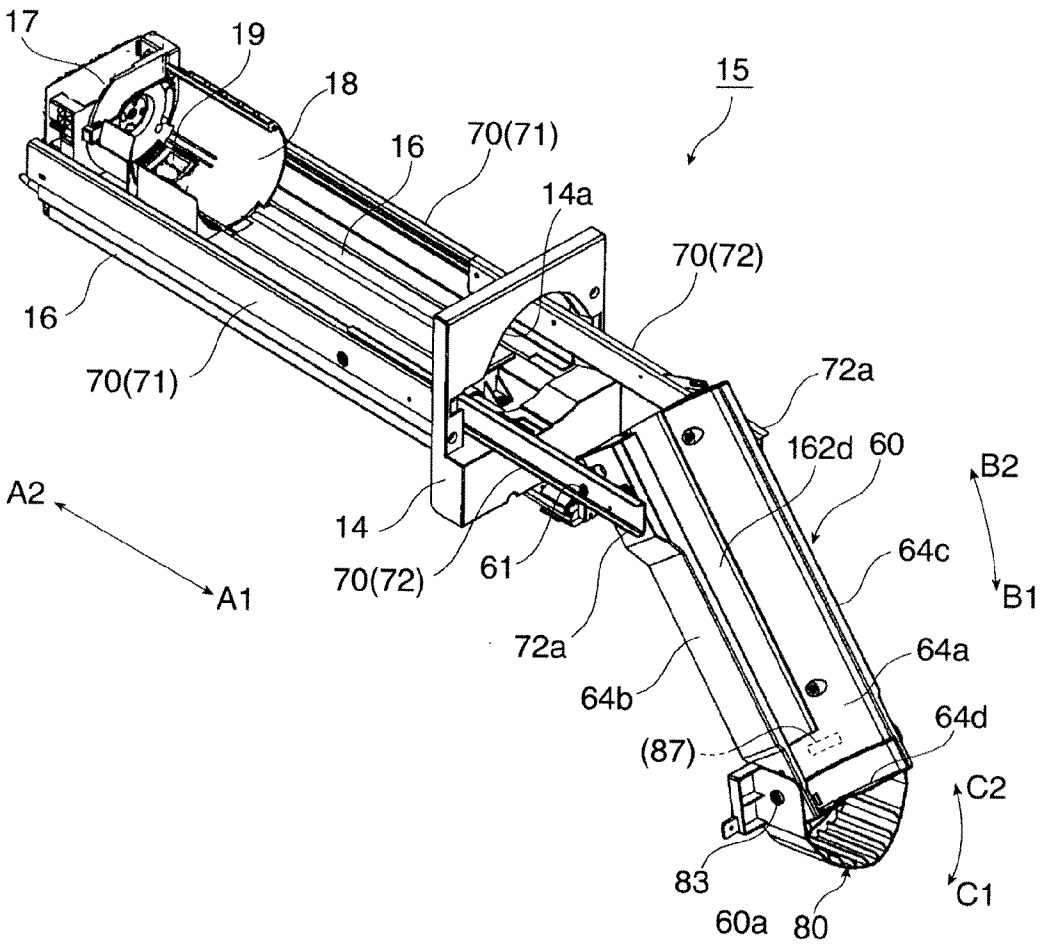
FIG. 5 is a perspective view showing a state in which the cartridge receiving table in the cartridge attaching portion of FIG. 4 is pulled out and is then brought down to the put-on and down position.

When the inner rail 72 is moved in the pull-out direction A1 of the cartridge put-on member 60, a portion including a downstream end portion 72*a* (end to be downstream side in pull-out direction of support member) on the pull-out side passes through the attaching through hole 14*a* of the front frame member 14 in the housing frame portion 16 of the cartridge attaching portion 15, and is moved to a position in which it is protruded in a desirable amount to the outside of the housing frame portion 16, and furthermore, the outside of the housing 10 and is thus stopped therein (see FIGS. 3A and 5 etc.). The inner rail 72 is stopped in the pull-out through a collision of a part of the inner rail 72 with a stopping protruded portion (not shown) provided on the cuter rail 71, for example. When the inner rail 72 is moved in a push-in direction A2 of the cartridge put-on member 60, moreover, the portion including the downstream end portion 72*a* on the pull-out side is moved to a position in which it is perfectly accommodated in the housing frame portion 16 of the cartridge attaching portion 15, and furthermore, the housing 10 and is thus stopped therein (see FIG. 4). The inner rail 72 is stopped in the push-in through a collision of a part of the cartridge 50 with a stopping portion (a wall surface) formed in the attaching portion 15 (a front end portion), for example.

Figure 6:
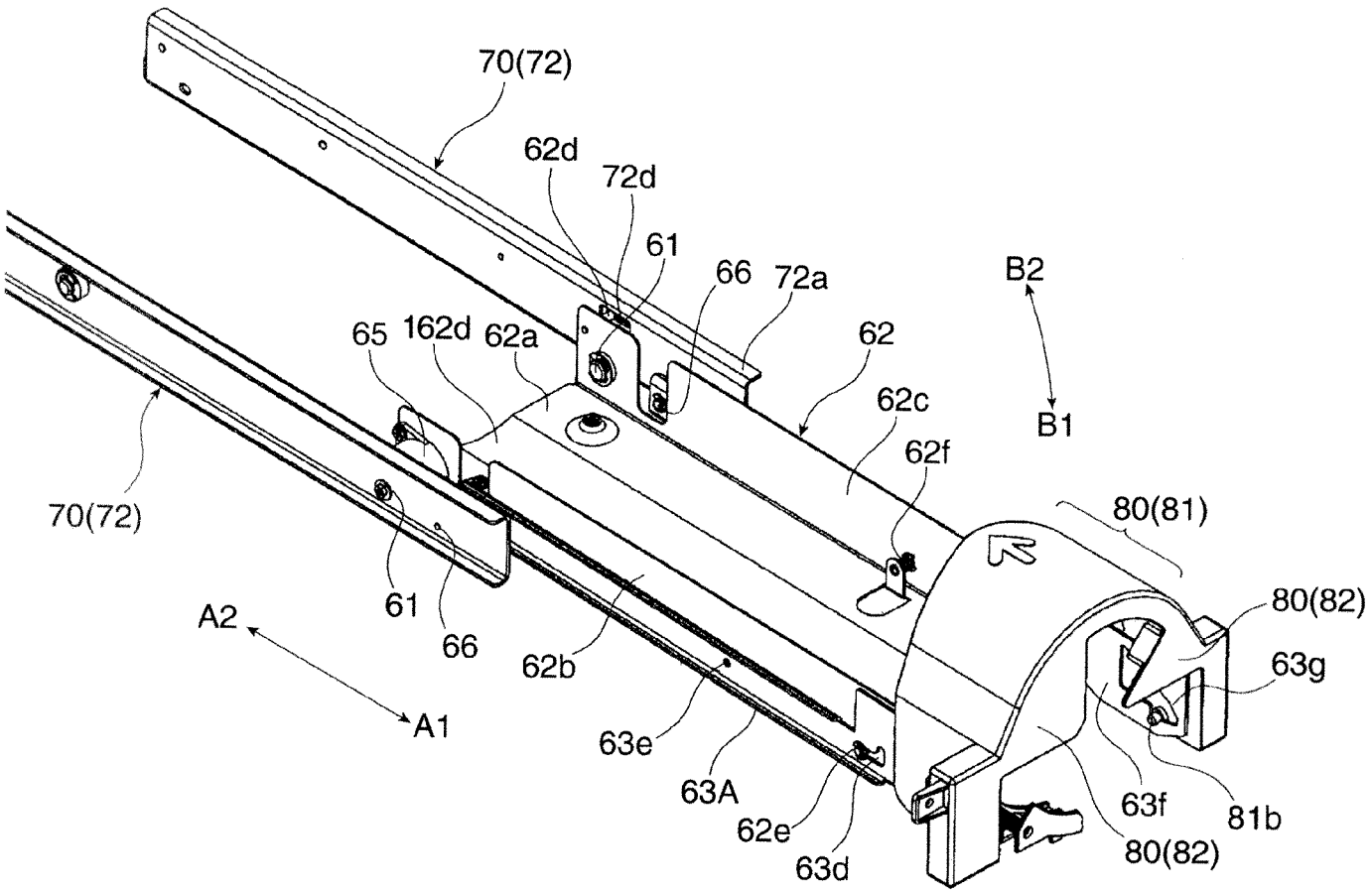
FIG. 6 is a perspective view showing a state in which the cartridge receiving table (omitted partially) in the cartridge attaching portion of FIG. 4 is pulled out to the pull-out completing position.

The cartridge put-on member 60 is constituted by a body frame 62, rock aiding arms 63A and 638 and an outer casing 64 serving as a cartridge holding portion as shown in FIGS. 5 and 6.

As shown in FIG. 6, the body frame 62 is a structure taking such a configuration as to have a rectangular bottom plate portion 62*a* provided with a cartridge receiving groove 162*d* in an almost central part in a longitudinal direction and side plate portions 62*b* and 62*c* with ends on both sides in the pull-out direction A1 in the bottom plate portion 62*a* bent upward. In the body frame 62, ends on the upstream side in the pull-out direction A1 in the side plate portions 62*b* and 62*c* are supported through the rotating shaft 61 provided between the body frame 62 and the inner rail 72 in the slide rail 70. Consequently, the whole body frame 62 is rocked in directions shown in arrows B1 and B2 (a downward direction B1 and an upward direction B2) around the rotating shaft 61 with respect to the slide rail 70 (the inner rail 72) as shown in FIGS. 6 and 7.

Figure 7:
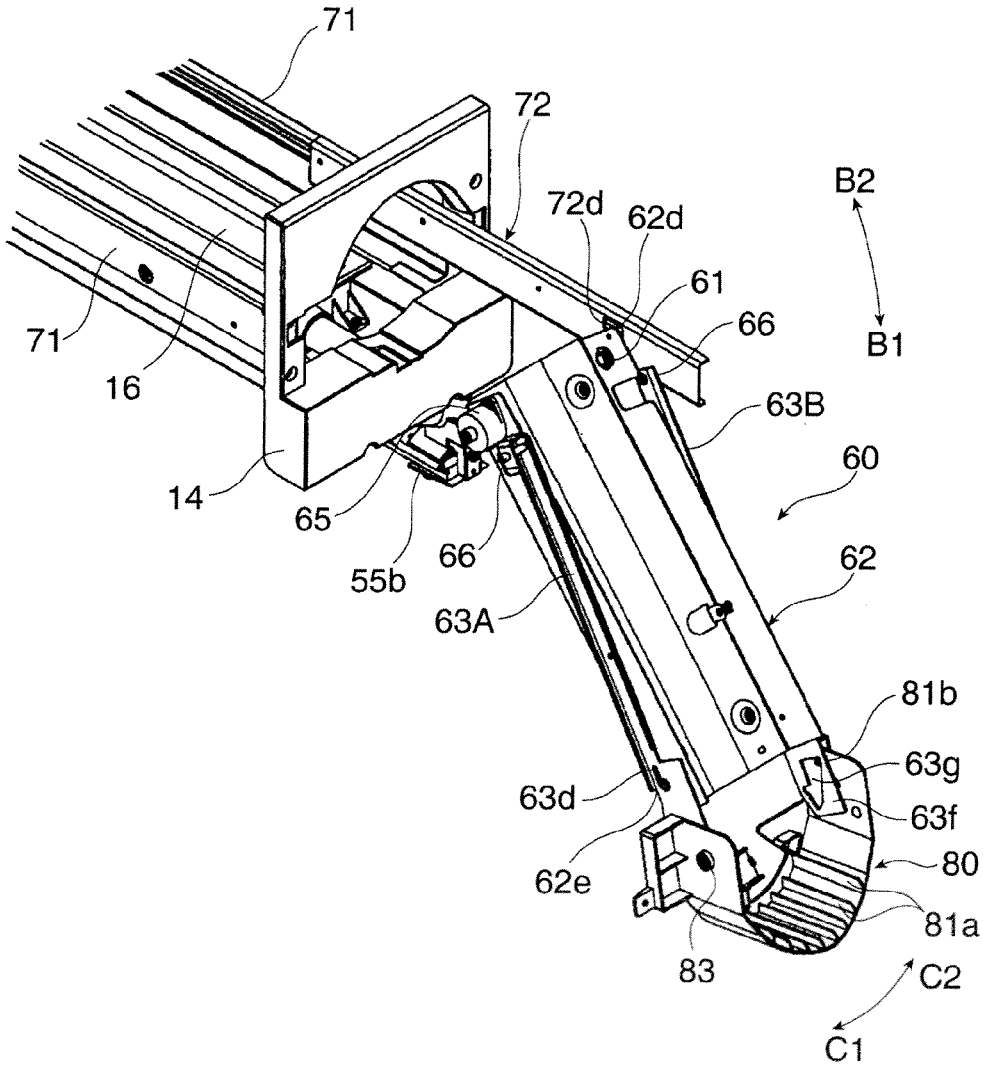
FIG. 7 is a perspective view showing a state in which the cartridge receiving table (omitted partially) in the cartridge attaching portion of FIG. 4 is brought down to the put-on and down position.
Figure 8:
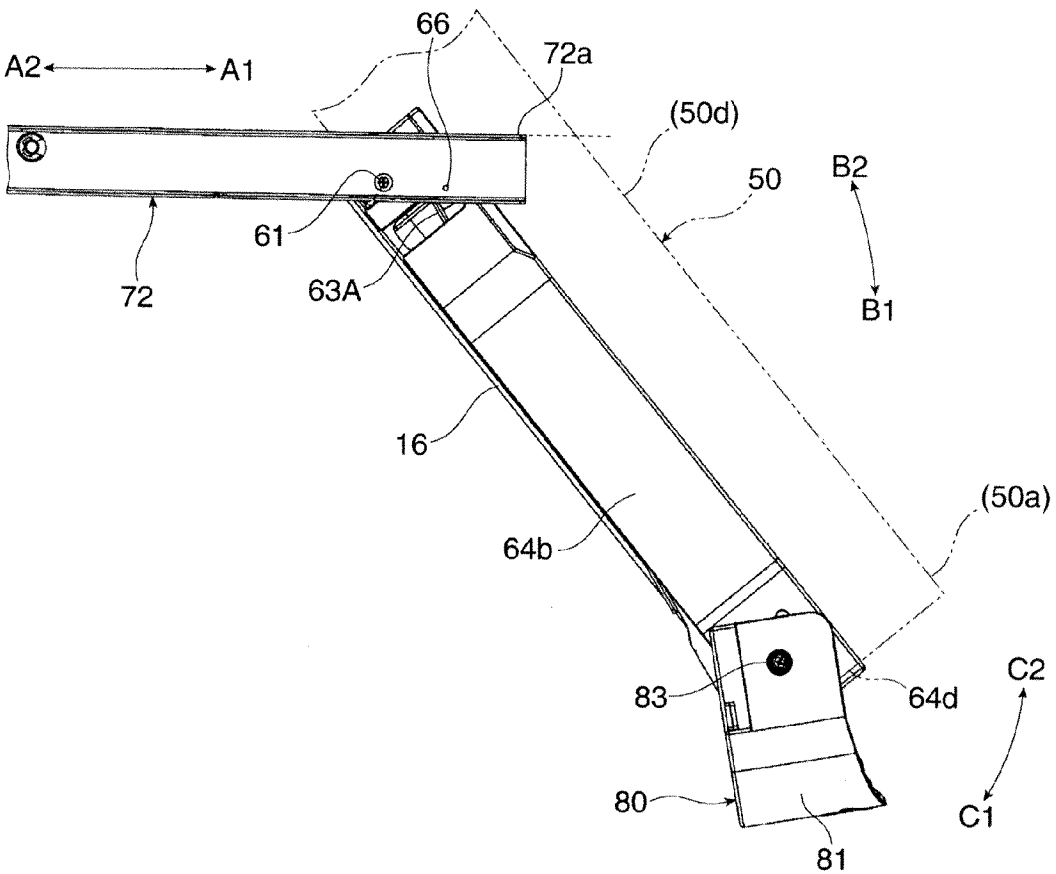
FIG. 8 is a side view showing a state the cartridge receiving table placed in the put-on and down position of FIG. 5 (a projection view in a parallel direction with a rotating shaft 61)

The inner rail 72 in the slide rail 70 which supports the body frame 62 employs a structure in which the downstream end portion 72*a* on a downstream side (a front end side) in the pull-out direction A1 is present in a position to satisfy a condition that it is placed in a position at the upstream side (a rear end side) in the pull-out direction A1 from at least an upper surface 50*d* of the toner cartridge 50 (upper surface of developer container) when the toner cartridge 50 is put on the body frame 62 (finally, the cartridge receiving table 60) set into a state in which it is brought downward to the cartridge put-on and down position as shown in FIGS. 7 and 8. In her words, as shown in FIG. 8, the downstream end portion 72*a* the inner rail 72 is positioned in a projection region (a region drawn in a two-dotted chain line of FIG. 8) in a projection in a parallel direction with the rotating shaft 61 of the toner cartridge 50 put on the put-on member 60 which is brought down to the cartridge put-on and down position and is thus disposed in a non-protrusion state.

Moreover, the rotating shaft 61 for attaching the body frame 62 is disposed on a downstream end side (a side on which the downstream end portion 72*a* is present) to be a downstream side (a front end side) in the pull-out direction A1 of the inner rail 72 as shown in FIGS. 6 and 7, for example. In the embodiment, the rotating shaft 61 is provided on a slightly inner part of the downstream end portion 72*a* in the pull-out direction A1 of the inner rail 72.

Moreover, the inner rail 72 of the slide rail 70 is pulled out in a state in which it is protruded to the outside of the housing 10 in order to satisfy a condition that an installing portion of the rotating shaft 61 is present on the outside of the housing 10 in the pull-out and the rocking operation of the cartridge put-on member 60 to be rocked around the rotating shaft 61 can be carried out without a hindrance. In addition, the body frame 62 is provided with a protruding bar 62*d* which is protruded toward an outside (a side on which the inner rail 72 is disposed) in a portion placed apart from the rotating shaft 61 at an end on the upstream side in the pull-out direction A1 in the side plate portion 62*c*. Moreover, the protruding bar 62*d* has a tip portion inserted in a rocking range regulating slot 72*d* formed on the inner rail 72. In the case in which the body frame 62 is rocked in the downward direction B1, consequently, the rocking motion in the downward direction B1 is stopped when the protruding bar 62*d* collides with one of ends of the rocking range regulating slot 72*d* (an end on the downstream side in the pull-out direction A1). In the case in which the body frame 62 is rocked in the upward direction B2, moreover, the rocking motion in the upward direction B2 is stopped when the protruding bar 62*d* collides with the other end of the rocking range regulating slot 72*d* (an end on the upstream side in the pull-out direction A1).

Furthermore, the body frame 62 has a one-way clutch 65 attached thereto in a state in which it is provided between the body frame 62 and the inner rail 72. The one-way clutch 65 exhibits a braking force against a rotating motion only when the body frame 62 is rocked around the rotating shaft 61 in the downward direction B1. In particular, consequently, in the case in which the toner cartridge 50 having a toner accommodated fully therein is put on or the toner cartridge 50 having the toner set into an almost empty state is put on, consequently, the body frame 62 having the cartridge 50 put thereon can be prevented from being suddenly started to be brought down with their dead weights by receiving the braking force of the one-way clutch 65 when they are pulled cut to the pull-out completing position. Moreover, the body frame 62 is slowly rocked upon receipt of the braking force of the one-way clutch 65 after an operator's manual downward operation is started when it is to be rocked in the downward direction B1, and the body frame 62 is easily rocked without receiving the braking force of the one-way clutch 65 after an operator's manual upward operation is started when it is to be rocked in the upward direction B2. The braking force of the one-way clutch 65 is set into a condition that there is exhibited a suitable braking force for a state or a motion which is required for the body frame 62.

As shown in FIGS. 6 and 7, each of the rock aiding arms 63A and 63B has one of ends attached rockably through an attaching shaft 66 provided in a position between the downstream end portion 72*a* of the inner rail 72 and a portion in which the rotating shaft 61 is disposed. Moreover, each of the rock aiding arms 63A and 63B has the other end attached through a slot 63*d* to a support shaft 62*e* provided with a protrusion toward an outside of the end on the downstream side in the pull-out direction A1 in each of the side plate portions 62*b* and 62*c* of the body frame 62. When the body frame 62 is rocked in the downward direction B1, consequently, each of the rock aiding arms 63A and 63B has one of ends supported on the inner rail 72 in order to lift a portion on the tip side of the body frame 62 (finally, the cartridge put-on member 60) which is brought down, and regulates an amount of the downward movement (an angle for the downward movement).

Moreover, each of the rock aiding arms 63A and 63B has a hole (or a concave portion) 63*e* formed in an almost central part in a longitudinal direction thereof. In addition, the body frame 62 is provided with a movable pin 62*f*. The movable pin 62*f* is wholly attached to a part of the bottom plate portion 62*a* (a notch bending portion), and is supported in a state in which a tip portion penetrates through the side plate portions 62*b* and 62*c* and is thus moved in a forward and backward direction toward the hole 63*e* of each of the rock aiding arms 63A and 63B. The movable pin 62*f* is pressurized toward the outside of the side plate portions 62*b* and 62*c* upon receipt of a pressing force of a spring, for example, and wholly carries out the forward and backward movement elastically. When the body frame 62 is rocked in the upward direction B2 into an almost horizontal state so that the movable pin 62*f* is opposed to the hole 63*e* of each of the rock aiding arms 63A and 63B, consequently, the tip portion of the movable pin 62*f* enters the hole 63*e* and is held in an almost horizontal state. On the other hand, when the body frame 62 is rocked in the downward direction B1, the movable pin 62*f* is set to have a positional relationship in which it is shifted from the hole 63*e* of each of the rock aiding arms 63A and 63B so that the tip portion of the movable pin 62*f* slips out of the hole 63*e* and a rocking motion in the downward direction B1 can be carried out.

As shown in FIG. 5, the outer casing 64 is a member having a cartridge receiving region portion 64*a* formed to take a shape of a curved surface which is linked to the cartridge receiving groove 162*d* in the bottom plate portion 62*a* of the body frame 62, and cover region portions 64*b* and 64*c* formed to take such a shape that each of the side plate portions 62*b* and 62*c* of the body frame 62 and the one-way clutch 65 can be hidden from an upper end of the cartridge receiving region portion 64*a* at an outside thereof. A stopping surface portion 64*d* is formed on an end to be the downstream side in the pull-out direction A1 in the cartridge receiving region portion 64*a*. The stopping surface portion 64*d* inhibits the whole toner cartridge 50 from being moved and shifted toward the downstream side in the pull-cut direction A1 in the cartridge put-on member 60 in contact of a part of the end face of the toner cartridge 50 on which the handle 53 is formed.

Moreover, the cartridge put-on member 60 is provided with a holding (protecting) cover 80 of a moving type as shown in FIGS. 5 to 7. The holding (protecting) cover 80 serves to hold an end 50*a* of the toner cartridge 50 with a part thereof covered in order to prevent the toner cartridge 50 from slipping off when the toner cartridge 50 is put on the put-on member 60 set into a rocking and tilting state to the cartridge put-on and down position.

The protecting cover 80 is a structural body having an arch-shaped outer peripheral surface holding portion 81 for holding (protecting), in an external covering state, an upper outer peripheral surface of the end 50*a* on the side where the handle portion 53 of the toner cartridge 50 is formed, and an end face holding portion 82 formed on one of the ends of the cuter peripheral surface holding portion 81 and serving to hold a part of a cartridge end face 50*c* having the handle portion 53 in a contact enabling state. The outer peripheral surface holding portion 81 has a plural ribs (protruded portions) 81*a* formed on an internal surface thereof, and each of the ribs 81*a* is constituted to hold the upper outer peripheral surface of the end 50*a* of the toner cartridge 50 in contact therewith.

The holding cover 80 is attached in such a manner that a lower part of the outer peripheral surface holding portion 81 is rocked in directions shown in arrows C1 and C2 (a direction for releasing the hold is indicated as C1 and a holding direction is indicated as C2) through a rotating shaft 83 provided an extended plate 63*f* which is extended and formed on a free end (an end having the slot 63*d*) of each of the rock aiding arms 63A and 63B. Moreover, the holding cover 80 is held in a state in which a guide pin 81*b* provided on a lower internal surface of the outer peripheral surface holding portion 81 is guided along an edge part of a guide hole 63*g* formed on the extended plate 63*f* of each of the rock aiding arms 63A and 63B and is stopped (the guide pin 81*b* is fitted in a stopping guide concave portion) in a position in which it is to be held in a rocking motion in the holding direction C2 (see FIG. 6).

Description will be given to an operation for attaching the toner cartridge 50 to the cartridge attaching portion 15 (which includes the contents of an operating work, and the following is the same) and an operation for removing the toner cartridge 50 from the cartridge attaching portion 15.

First of all, the attaching operation will be described. The opening door (not shown) provided before the inlet of the housing frame portion 16 in the cartridge attaching portion 15 of the housing 10 is first opened, and subsequently, the cartridge put-on member 60 stored in the housing frame portion 16 is manually pulled out to the outside of the housing 10 by an operator and is then brought downward in the pull-out state as shown in FIGS. 3A, 3B and 5.

In this case, when the cartridge put-on member 60 is pulled in the pull-cut direction A1, the inner rail 72 of the slide rail 70 is moved in the longitudinal direction of the outer rail 71 so that the cartridge put-on member 60 is moved rectilinearly and is pulled out from the storing position the pull-out completing position (see FIG. 3A). Moreover, part of the inner rail 72 pulled out collies with the stopping protruded portions of the outer rail 71 so that the cartridge put-on member 60 is stopped in the pull-out completing position. The height H2 of the cartridge put-on member 60 pulled out is on almost the level with the lowermost portion 15*a* of the cartridge attaching portion 15 (see FIG. 3A).

When the cartridge put-on member 60 is brought in the downward direction B1 in the pull-out completing position, moreover, the body frame 62 is rocked downward around the rotating shaft 61 provided on the inner rail 72 and the tip portion 60*a* on the downstream side in the pull-out direction A1 is brought down to the cartridge put-on and down position from the pull-out completing position to finally bring a state in which the whole cartridge put-on member 60 is tilted (see FIGS. 3B and 5).

At this time, the tip portion of the support pin 62*f* which is forward and backward movable in the body frame 62 slips out of the hole 63*e* of each of the rock aiding arms 63A and 63B so that the cartridge put-on member 60 is started to be rocked downward around the rotating shaft 61. Moreover, the cartridge put-on member 60 is slowly brought downward upon receipt of the braking force of the one-way clutch 65 provided together with the rotating shaft 61 when it is bought downward. Finally, the protruding bar 62*d* of the body frame 62 which is provided in the vicinity of the rotating shaft 61 collides with one of ends of a rocking range regulating slot 72*c* in the inner rail 72 so that the rocking motion of the cartridge put-on member 60 in the downward direction B1 is stopped and a portion provided on an inside of the end 60*a* at the front end side in the pull-out direction A1 is supported by the rock aiding arms 63A and 63B.

The height H3 of the put-on and down position of the tip portion 60*a* of the cartridge put-on member 60 shifted to the cartridge put-on and down position is lower by $\Delta h$ than the height H2 of the pull-out completing position (see FIG. 3B). Moreover, the cartridge put-on member 60 at this time is wholly tilted by a predetermined angle $\theta$ around the rotating shaft 61 (see FIGS. 3B and 5).

Consequently, a part of the position (state) in which the toner cartridge 50 is put on the cartridge put-on member 60 is lower than that in the case in which it is put on at the height H2 of the pull-out completing position, for example. Therefore, it is possible to easily put the toner cartridge 50 on the cartridge put-on member 60 without requiring lifting the whole toner cartridge 50 to an unnecessarily high position.

When the cartridge put-on member 60 is shifted to the cartridge put-on and down position, moreover, the downstream end portion 72*a* in the pull-out direction A1 of the inner rail 72 in the slide rail 70 is maintained in a state in which an amount of protrusion from an upper side part of a side surface of the cartridge put-on member 60 is small as shown in FIGS. 5 and 8.

When the work for putting the toner cartridge 50 on the cartridge put-on member 60 is to be carried out, consequently, the presence of the downstream end portion 72*a* of the inner rail 72 is not an obstacle. When the toner cartridge 50 is to be put on, the holding cover 80 placed on the cartridge put-on member 60 is maintained to be opened (or brought down)

through a rocking motion around the rotating shaft 83 in the hold releasing direction C1 (see FIGS. 5 and 8).

Figure 9:
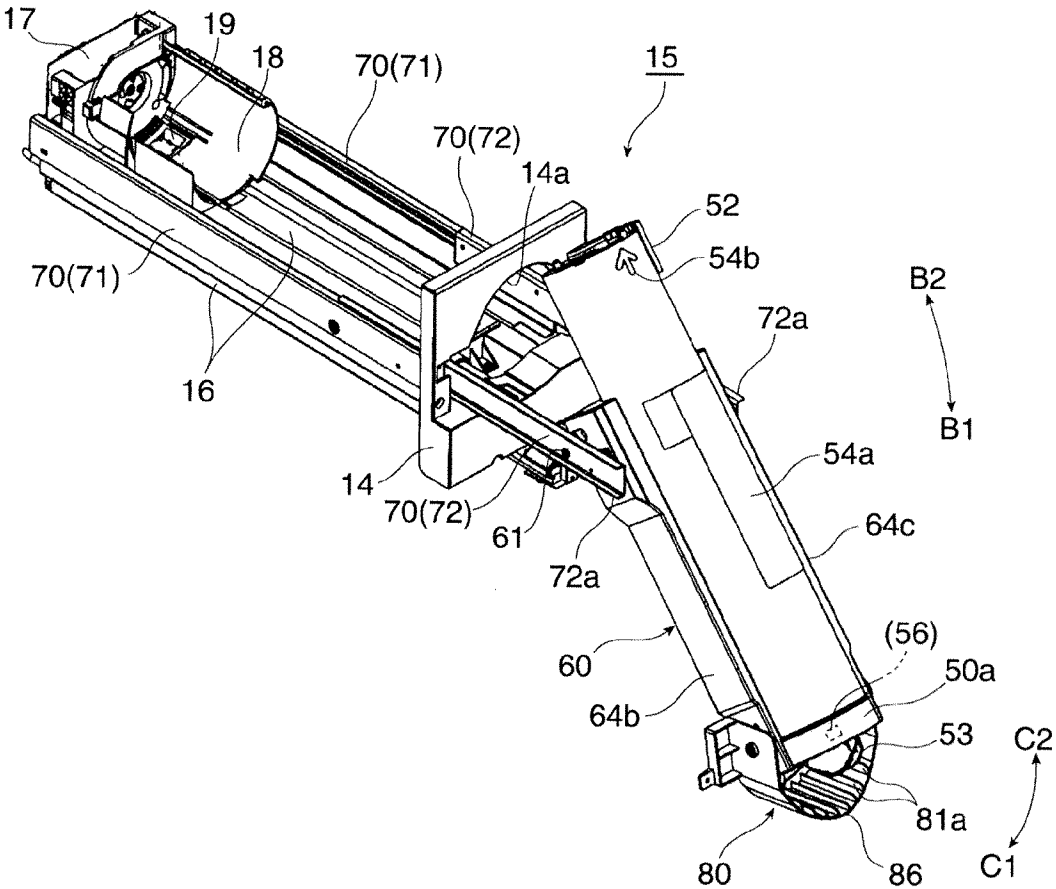
FIG. 9 is a perspective view showing a state in which the toner cartridge is put on the cartridge receiving table placed in the put-on and down position of FIG. 5 (a state in which a holding cover is opened)

The toner cartridge 50 to be attached is put on the cartridge put-on member 60 which is shifted to the cartridge put-on and down position and is set into an oblique state as shown in FIG. 9.

In this case, the toner cartridge 50 is put on the put-on member 60 in an oblique state in which the end 50*a* on the side where the handle portion 53 is provided is turned downward. At this time, apart of the end face 50*d* having the handle portion 53 comes in contact with the stopping surface portion 64*d* (see FIGS. 5 and 8) in the outer casing 64 of the cartridge put-on member 60 so that an obliquely downward movement of the toner cartridge 50 is blocked. Moreover, the toner cartridge 50 at this time is put on in a state in which the toner discharging port 51 is shifted from the toner intake 19 in the cartridge attaching portion 15 in a circumferential direction. In the embodiment, it is possible to confirm that a put-on state (posture) of the toner cartridge 50 is correct by bringing a state in which the longitudinal direction of the handle portion 53 taking a shape of an arcuate plate in the toner cartridge 50 is almost coincident with a vertical direction in the end face of the cartridge or bringing a state in which the information displaying portion 54 (an arrow displaying portion 54*b*) given to the outer peripheral surface of the cartridge is positioned on an almost uppermost part as shown in FIG. 9.

Figure 10:
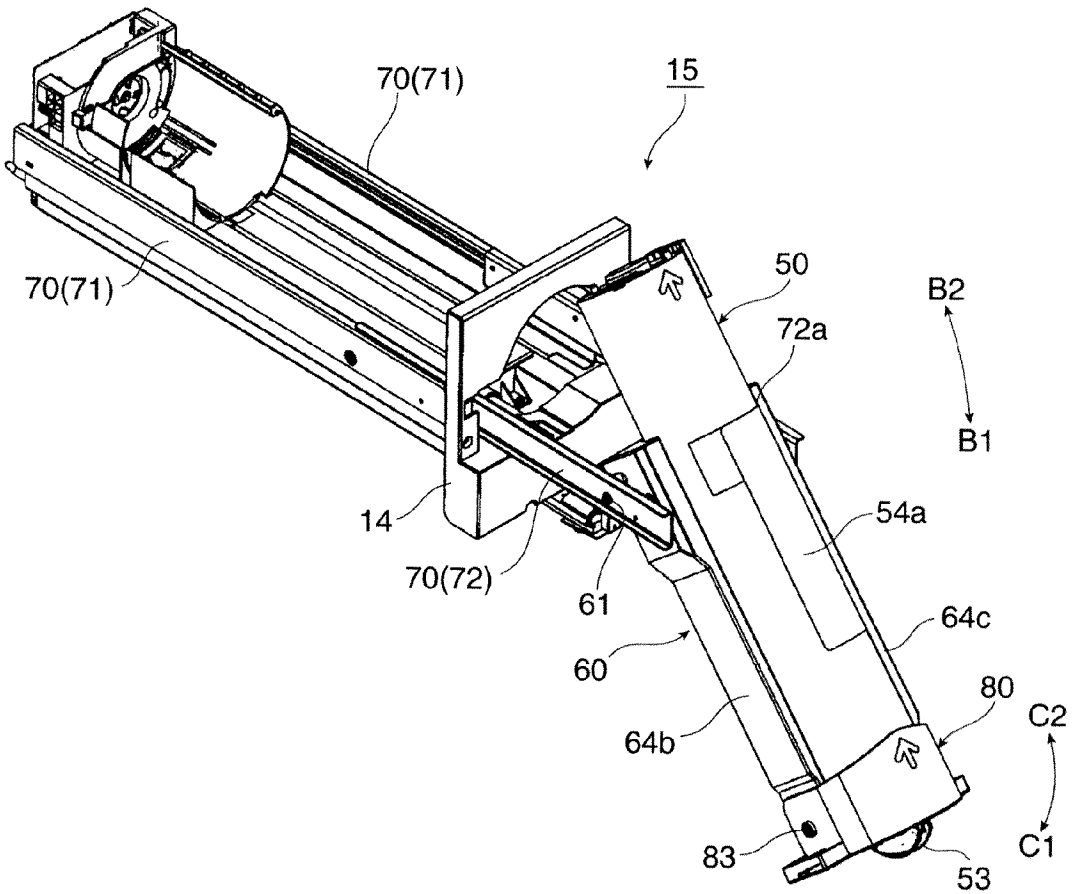
FIG. 10 is a perspective view showing a state in which the toner cartridge is put on the cartridge receiving table placed in the put-on and down position of FIG. 5 and the holding cover is thus closed.

After the toner cartridge 50 is put on the cartridge put-on member 60, the holding cover 80 placed on the cartridge put-on member 60 is first rocked in the holding direction C2 around the rotating shaft 83 and is thus brought into a closing (or erecting) state as shown in FIG. 10.

Consequently, the toner cartridge 50 put on the cartridge put-on member 60 set into an oblique state is held in a state in which a part of the outer peripheral surface and the end face in the end 50*a* disposed on a lower side is surrounded by the outer peripheral surface holding portion 81 and the end face holding portion 82 in the holding cover 80 (see FIG. 6), and is maintained in a stable state in which it is hard to slip out of the put-on member 60.

Figure 11:
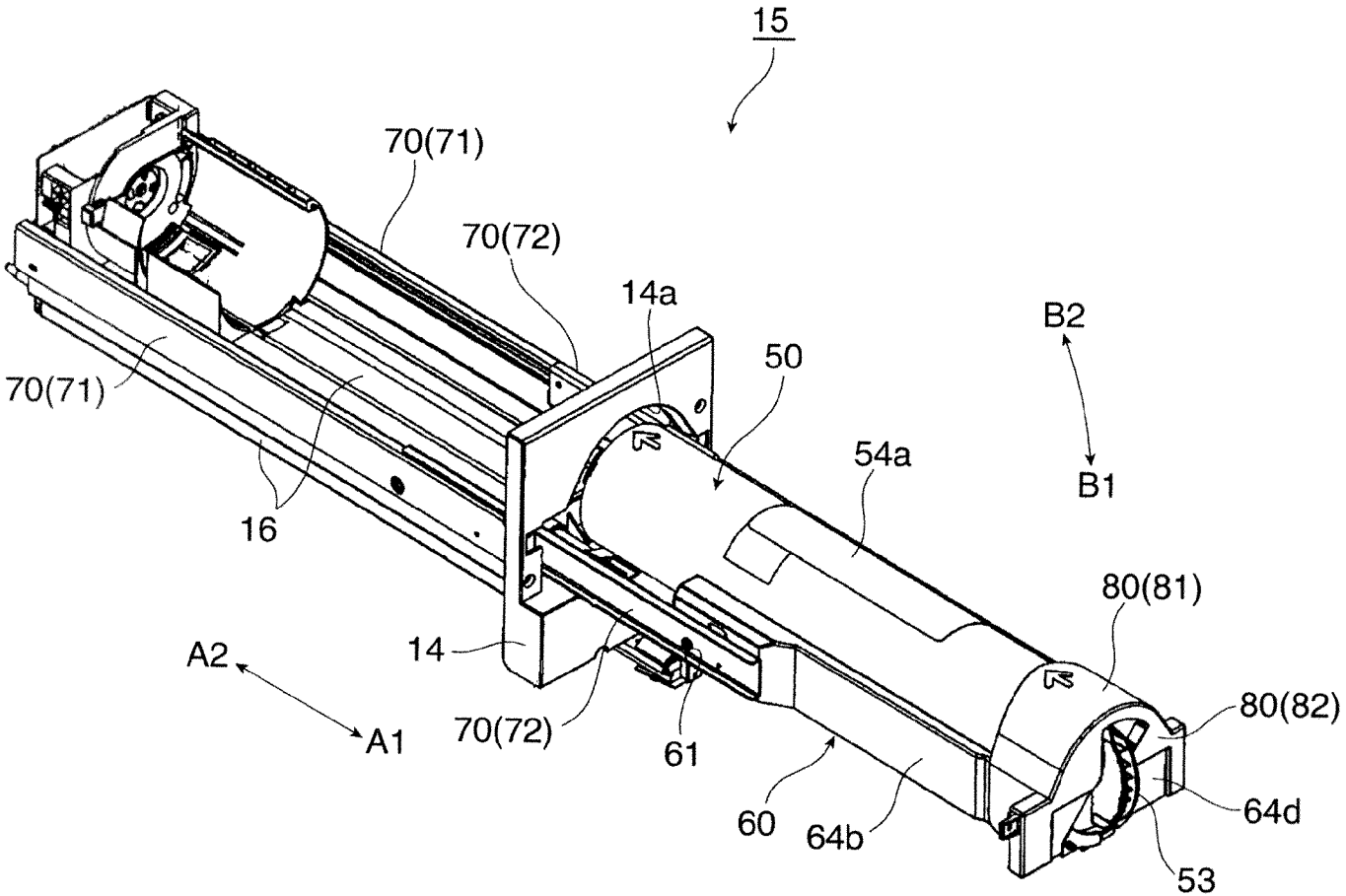
FIG. 11 is a perspective view showing a state of the cartridge receiving table which puts the toner cartridge thereon and is placed in the pull-out completing position.

Subsequently, (the end 50*a* of the cartridge put-on member 60 having the toner cartridge 50 put thereon and set into the oblique state in the cartridge put-on and down position is lifted upward and is returned to the pull-cut completing position as shown in FIG. 11.

In this case, when the cartridge put-on member 60 is lifted in the upward direction B2, the body frame 62 is rocked upward around the rotating shaft 61 provided on the inner rail 72, and the tip portion 60*a* on the downstream side in the pull-out direction A1 is moved upward to the height H2 of the pull-out completing position from the cartridge put-on and down position, and the whole cartridge put-on member 60 is finally brought into an almost horizontal state (see FIGS. 3A and 11).

The cartridge put-on member 60 at this time is lifted without receiving the braking force of the one-way clutch 65 provided together with the rotating shaft 61. When the cartridge put-on member 60 is lifted to the pull-cut completing position, moreover, the protruding bar 62*d* of the body frame 62 which is provided in the vicinity of the rotating shaft 61 collides with the other end of the rocking range regulating slot 72*c* in the inner rail 72. Consequently, the rocking motion in the upward direction B2 is blocked and stopped. When the cartridge put-on member 60 is lifted to the pull-out completing position, furthermore, the forward and backward movable support pin 62*f* in the body frame 62 is fitted in the hole 63*e* of each of the rock aiding arms 63A and 635 (see FIG. 6). Consequently, the whole cartridge put-on member 60 is maintained in an almost horizontal state.

Subsequently, the cartridge put-on member 60 having the toner cartridge 50 put thereon and lifted to the pull-out completing position is pushed into the housing frame portion 16 of the cartridge attaching portion 15 and is thus stored as shown in FIGS. 2 and 4.

In this case, when the cartridge put-on member 60 is pushed in the push-in direction A2, the inner rail 72 of the slide rail 70 is moved rectilinearly in the longitudinal direction of the outer rail 71. Consequently, the cartridge put-on member 60 is pushed from the pull-out completing position to the storing position and is thus stored. When an end 50*b* on an opposite side to the end 50*a* at the handle portion 53 side of the toner cartridge 50 comes in contact with a portion such as a wall surface portion on an inner side of the attaching portion 15, moreover, the movement of the cartridge put-on member 60 in the push-in direction A2 is perfectly stopped. At this time, the end face holding portion 82 in the holding cover 80 of the cartridge put-on member 60 is maintained to be stored in the attaching through hole 14*a* of the front frame member 14 (see FIG. 4). At this time, the toner cartridge 50 is maintained to be stored in the space of the housing frame portion 16 in the cartridge attaching portion 15.

Finally, the toner cartridge 50 stored in the cartridge attaching portion 15 is turned by a predetermined angle in a direction shown in an arrow D1 (a cover opening direction) in the cartridge put-on member 60 to change a posture in order to open the opening cover 52 (see FIG. 4). In this case, the toner cartridge 50 is turned by a predetermined angle in the cover opening direction D1 by holding the handling portion with a hand. Consequently, only the opening cover 52 collides with a part of the cartridge holding frame 18 and is continuously maintained to be stopped. On the other hand, the toner discharging port 51 of the toner cartridge 50 (see FIG. 2) is released from the closing state of the opening cover 52 and is thus shifted to an opposed position to the toner intake 19 in the cartridge attaching portion 15 (see FIG. 5). After the operation, there is closed the opening door (not shown) provided before the inlet of the housing frame portion 16 in the cartridge attaching portion 15 of the housing 10.

By carrying out the operating work, the toner cartridge 50 is perfectly attached to the cartridge attaching portion 15 (see FIGS. 1, 2 and 4).

On the other hand, the operation for removing the toner cartridge 50 from the cartridge attaching portion 15 is carried out in a reverse procedure to the attaching operation. The removing operation is executed in an exchange of the toner cartridge 50, for example.

More specifically, the opening door (not shown) provided before the inlet of the housing frame portion 16 in the cartridge attaching portion 15 of the housing 10 is first opened and is then turned in a direction shown in an arrow D2 (a cover closing direction) by a predetermined angle to change a posture in order to close the opening cover 52 provided in the toner cartridge 50 (see FIG. 4).

Subsequently, the cartridge put-on member 60 having the toner cartridge 50 put thereon is pulled in the pull-out direction A1 and is thus pulled out from the storing position to the pull-out completing position to be the outside of the housing 10 (see FIGS. 3A and 11). Thereafter, the cartridge put-on member 60 is rocked in the downward direction B1 in the pull-cut completing position and is thus brought downward to the cartridge put-on and down position (see FIGS. 3B and 10). Finally, the holding cover 80 provided on the cartridge put-on member 60 is brought into an opening state (see FIG. 9).

Consequently, the toner cartridge 50 to be removed is put on the cartridge put-on member 60 placed in the cartridge put-on and down position and set into the oblique state in which the tip portion 60*a* in the pull-out direction A1 is positioned in the lower part. Therefore, the toner cartridge 50 is taken out of the cartridge put-on member 60 and is thus brought down. Moreover, the toner cartridge 50 to be attached is preferably put on the cartridge put-on member 60 from which the toner cartridge 50 to be removed is put down (see FIG. 5).

Thus, the toner cartridge 50 is removed from the cartridge attaching portion 15.

Also in the removal, the cartridge put-on member 60 on which the toner cartridge 50 to be removed is put has the height H3 of the put-on and down position of the tip portion 60*a* which is lower by Δh than the height H2 of the pull-out completing position (see FIG. 3B), and furthermore, is wholly tilted by a predetermined angle θ around the rotating shaft 61 (see FIGS. 3B and 9).

Consequently, a part of the position (state) in which the toner cartridge 50 is put down from the cartridge put-on member 60 is lower than that in the case in which it is put on at the height H2 of the pull-out completing position, for example. Therefore, it is possible to easily put the toner cartridge 50 down from the cartridge put-on member 60 without requiring lifting the whole toner cartridge 50 to an unnecessarily high position.

When the cartridge put-on member 60 on which the toner cartridge 50 to be removed is put is shifted to the cartridge put-on and down position, moreover, the downstream end portion 72*a* in the pull-out direction A1 of the inner rail 72 in the slide rail 70 is maintained in a state in which it is not protruded from the upper surface 50*d* of the toner cartridge 50 put on the cartridge put-on member 60 as shown in FIGS. 8 and 10. When the toner cartridge 50 is put down from the cartridge put-on member 60, consequently, the presence of the downstream end portion 72*a* in the pull-cut direction A1 of the inner rail 72 is not an obstacle.

When the cartridge put-on member 60 on which the toner cartridge 50 to be removed is put is being brought downward to the cartridge put-on and down position or is perfectly brought downward, furthermore, the toner cartridge 50 is held by the holding cover 80 provided on the cartridge put-on member 60 and is thus maintained in a stable state (see FIG. 10).

As shown in FIG. 1, the image forming apparatus 1 uses the toner cartridges 50Y, 50M, 50C and 50K for accommodating developers having different colors and is provided with cartridge attaching portions 15Y, 15M, 15C and 15K for exclusively attaching the toner cartridges 50. Therefore, the image forming apparatus 1 employs the following structure in which it is possible to easily determine, in the attaching work, whether or not the correct toner cartridge 50 to be put on the cartridge put-on member 60 in the cartridge attaching portion 15 is put on (the developer having any of the colors Y, M, C and K to be attached to the attaching portions 15 which is correct is accommodated therein).

Figure 12:
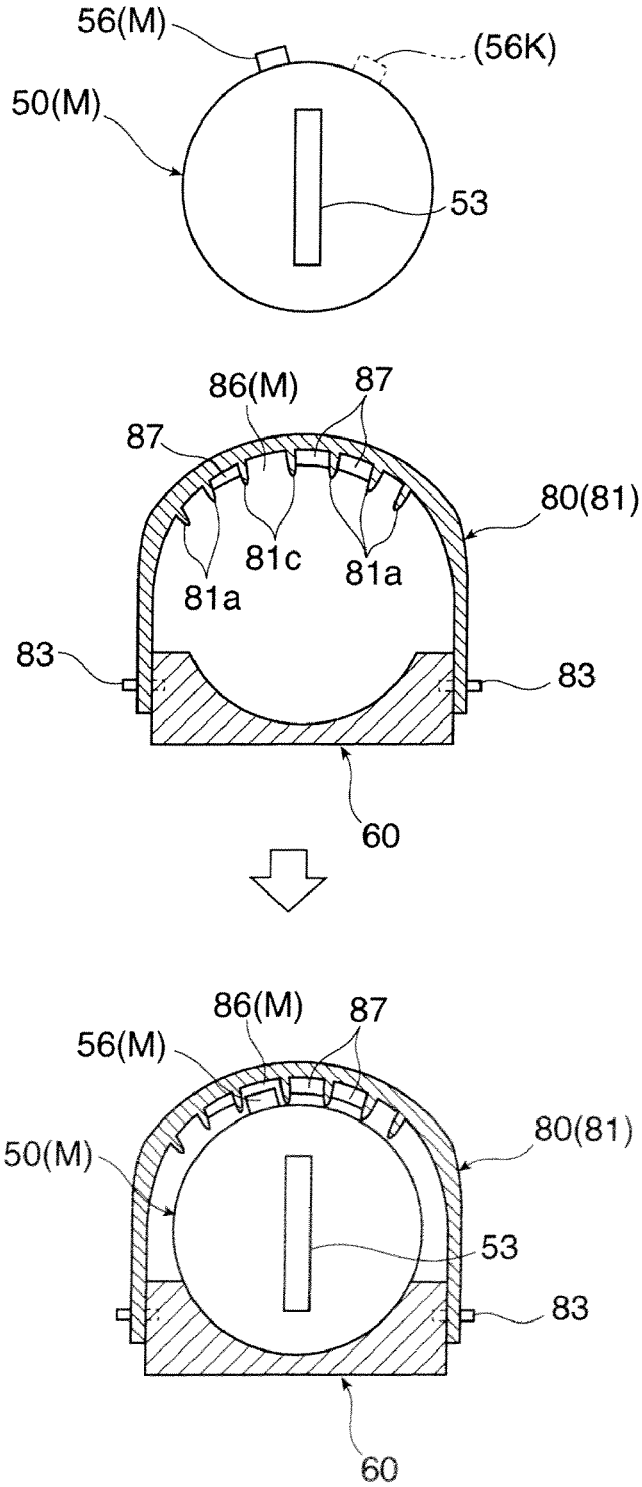
FIG. 12 is an explanatory view showing a state (a) in which an attached cartridge identifying concave portion is provided in the cartridge attaching portion of FIG. 2 and an attached cartridge identifying convex portion is provided in the toner cartridge (a portion placed above a downward arrow) and a using state thereof (b) (a portion placed below the downward arrow)

More specifically, as shown in FIG. 9 and an upper part of FIG. 12 (a portion placed above a downward arrow), an attached cartridge identifying concave portion 86 is formed on (an internal surface of the outer peripheral surface holding portion 81 of) the moving type holding cover 80 provided on the cartridge put-on member 60, while the attached cartridge identifying convex portion 56 (protruded portion) taking such a shape as to be fitted in the concave portion 86 is formed on (an outer peripheral surface of) the end 50*a* at a side on which the handle portion 53 of the toner cartridge 50 is disposed.

The attached cartridge identifying concave portion 86 of the holding cover 80 is formed by utilizing a part (a pair of ribs 81*c*) in the ribs 81*a* formed on the internal surface of the outer peripheral surface holding portion 81, and more specifically, a space interposed between a part of the ribs 81*c* is set to be a concave portion. Moreover, the attached cartridge identifying convex portion 56 of the toner cartridge 50 is formed in the outer peripheral surface portion of the end of the toner cartridge 50 which is present on a track in the rocking movement of the concave portion 86 provided in the holding cover 80 when there is brought a state in which the rocking motion is carried out in the direction C2 for holding the holding cover 80 (see FIG. 10).

Moreover, the attached cartridge identifying concave and convex portions 86 and 56 have installation positions varied for each type of the toner cartridge 50 (types divided by the colors Y, M, C and K of the developers to be accommodated). For example, the concave portion 86 and the convex portion 56 shown in FIG. 12 are applied to the magenta color M. The reference numeral 56K in FIG. 12 denotes a convex portion for the black color K. Positions in which the concave portion 86 and the convex portion 56 are formed are set based on that the posture of the handle portion 53 (for example, an orientation of the longitudinal direction) is set into a constant state (for example, the case in which the longitudinal direction is set into a state of the vertical direction: see FIGS. 9 and 12) when the toner cartridge 50 is put on the cartridge put-on member 60, for instance.

In the holding cover 80, furthermore, a wall portion 87 to partially close the concave portion space between the ribs 81*a* is formed in a portion between the ribs 81*a* which is not used as the attaching cartridge identifying concave portion 86. The wall portion 87 inhibits the convex portion 56 on the toner cartridge 50 side to pass through the concave portion (86) between the ribs 81*a* having the wall portion 87 from passing therethrough in the rocking motion in the direction C2 for holding the holding cover 80. In addition, the pair of ribs 81*c* constituting the concave portion 86 or the adjacent ribs 81*a* thereto take a shape in which corresponding parts are cut out in order to prevent the movement of the convex portion 56 in the circumferential direction from being disturbed when the ink cartridge 50 is stored in the attaching portion 15 and the opening cover 52 is then rotated in the opening direction D1 or they are not provided in the corresponding parts.

Since the attaching cartridge identifying concave and convex portions 86 and 56 are provided, the concave portion 86(M) for identifying the magenta color M which is provided in the holding cover 80 passes without a collision with the convex portion 56 for identifying the toner cartridge 50M and the holding cover 80 is rocked to a normal holding position (see FIG. 10) when the toner cartridge 50M for the magenta color M is put on the cartridge put-on member 60 which is brought downward to the cartridge put-on and down position (see FIG. 9) and they are then rocked in the direction C2 for holding the holding cover 80 (see FIG. 10) as shown in a lower part of FIG. 12 (a portion placed below the downward arrow). Consequently, it is possible to identify that the toner cartridge 50 put on the cartridge put-on member 60 is the correct toner cartridge 50M for the magenta color M.

On the other hand, in the case in which the toner cartridge 50K for the black color K to be another color is put on the cartridge put-on member 60, for example, the identifying convex portion 56(K) in the cartridge 50K collides with the wall portion 87 between the corresponding ribs 81*a* when the holding cover 80 is rocked in the holding direction C2, and the holding cover 80 is not rocked until a normal holding position is reached. Consequently, it is possible to identify that the toner cartridge 50 put on the cartridge put-on member 60 not the correct toner cartridge 50M for the magenta color M.

By providing the attaching cartridge identifying concave portion 86 in a part of the cartridge put-on member 60 (the holding cover 80 in the exemplary example), particularly, it is possible to ascertain whether the toner cartridge 50 is a correct toner cartridge to be originally put on or not when putting the toner cartridge 50 on the cartridge put-on member shifted to the cartridge put-on and down position. Consequently, it is possible to avoid a useless operation for putting the wrong toner cartridge 50 on the cartridge put-on member 60 and once storing them in the cartridge attaching portion 15.

Although the description has been given to the case in which the attaching cartridge identifying concave portion 86 is provided on the holding cover 80 of the cartridge put-on member 60 and the attaching cartridge identifying convex portion 56 is provided on the toner cartridge 50 in the exemplary example of the structure, it is also possible to employ a structure in which the attaching cartridge identifying concave portion is provided on the toner cartridge 50 and the attaching cartridge identifying convex portion is provided on the holding cover 80 of the cartridge put-on member 60 in place of a movable member such as the holding cover 80. Moreover, the attaching cartridge identifying convex and concave portions 56 and 86 may be provided on the other movable members disposed in the cartridge put-on member 60 in addition to the holding cover 80.

Although the description has been given to the case in which the attaching cartridge identifying concave portion 86 is provided on the holding cover 80 of the cartridge put-on member 60 in the exemplary example of the structure, furthermore, it is also possible to employ a structure in which the attaching cartridge identifying concave portion (87) is provided on another part of the cartridge put-on member 60 (for example, a bottom part of the outer casing 64: see FIG. 5). In this case, it is preferable that an attached cartridge identifying convex portion (57) provided on the toner cartridge 50 should be disposed in a part of the cuter peripheral surface of the cartridge corresponding to the concave portion 87 (see FIG. 2).

Another Exemplary Embodiment

Figure 13A:
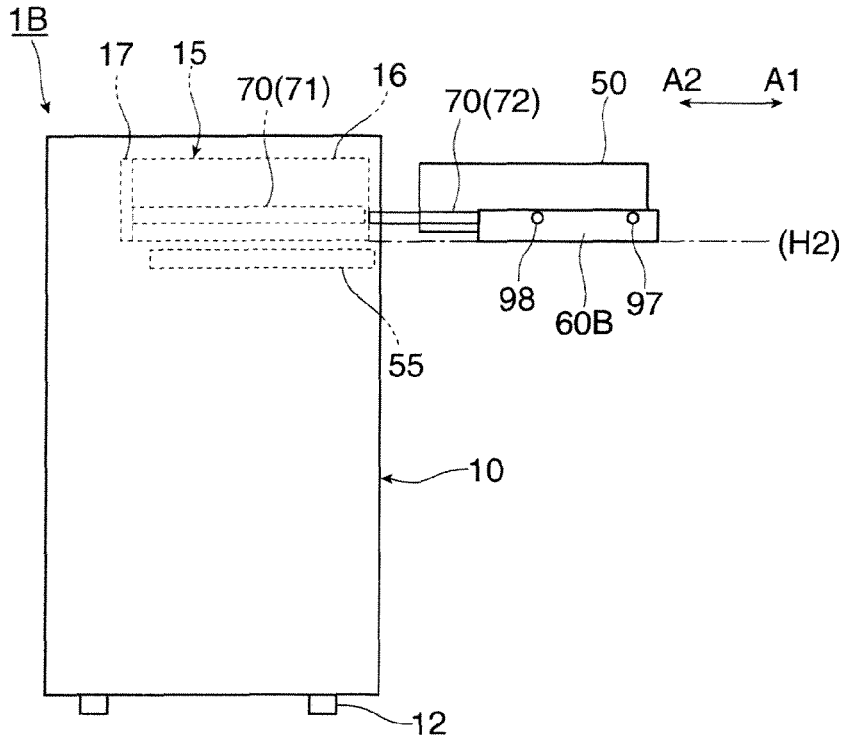
FIGS. 13A and 13B are explanatory views showing states related to another exemplary example of the structure of the main part (the cartridge attaching portion) of the image forming apparatus in FIG. 2
Figure 13B:
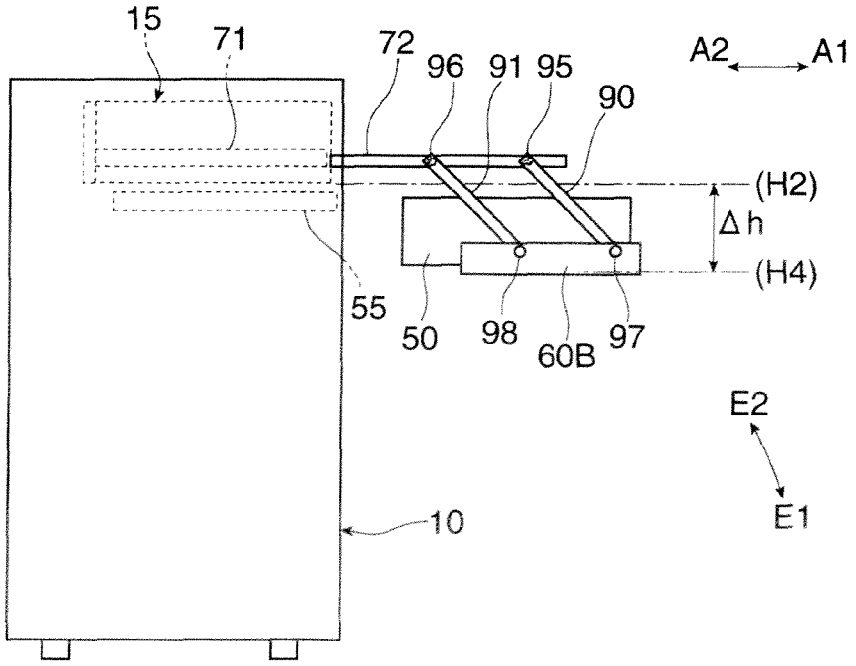

FIGS. 13A and 13B show an image forming apparatus according to another exemplary embodiment of the invention, illustrating states seen from a side surface side of the image forming apparatus.

In contrast to the image forming apparatus 1 according to the exemplary embodiment, an image forming apparatus 1B according to the exemplary embodiment has a structure for attaching a cartridge put-on member 60 of a cartridge attaching portion 15 which is partially different as will be described below, and the other portions have almost the same structures.

A cartridge put-on member 60B of the cartridge attaching portion 15 in the image forming apparatus 1B is attached downward movably to a predetermined part of a slide rail through link members 90A, 90B, 91A and 91B so as to be shifted to a cartridge put-on and down position (a position in which the put-on member 60B is set into a state shown in FIG. 3B) which is a lower position of H4 (<H2) than a height H2 of a pull-out completing position of the whole put-on member 60B (a height from an installation surface 100) and to be thus stopped as shown in FIGS. 13A to 17. The designation Δh in FIG. 13B indicates a maximum difference between the height H2 of the pull-out completing position and the height H4 of the cartridge put-on and down position, and arrows E1 and E2 denote a direction for moving the cartridge put-on member 60B downward and a direction for moving the cartridge put-on member 60B upward. The reference numeral 69 in FIG. 14 denotes a handle of the cartridge put-on member 60B.

Both of the link members 90 and 91 are long plate members and have a guiding slot 92 formed on central parts in a longitudinal direction thereof. Moreover, each of the link members 90 and 91 has one of ends which is attached to a predetermined position of an inner rail 72 of the slide rail 70 at an interval and has the other end which is attached to a predetermined position in a side part cartridge put-on member 60B at an interval.

In detail, one of the ends of each of the link members 90 and 91 is attached in a movable state by inserting, into each of the guiding slots 92, each of attaching shafts (rotating shafts) 95 and 96 provided on an internal surface side of the inner rail 72 at an interval. The attaching shafts 95 and 96 are provided on a downstream end portion 72*a* in a pull-out direction A1 of the inner rail 72 and in a position shifted to an upstream side of the pull-out direction A1 from the downstream end portion 72*a*. Moreover, the other ends of the link members 90 and 91 are attached in a rotatable state through attaching holes (not shown) formed on the other ends to attaching shafts 97 and 98 provided on the side part of the cartridge put-on member 60B at an interval (which is almost equal to an interval between the attaching shafts 95 and 96). The attaching shafts 97 and 98 are provided on the downstream end p on 72*a* in the pull-out direction A1 in the side part of the cartridge put-on member 60B and a position shifted to the upstream side in the pull-out direction A1 from the downstream end portion 72*a*.

Moreover, the guiding slots 92 in the link members 90 and 91 are formed in lengths to maintain an amount of a movement required for a downward movement from the pull-out completing position of the cartridge put-on member 60B to the cartridge put-on and down position by the predetermined height difference Δh and an amount of a movement required for holding an almost parallel state with the inner rail 72 in the pull-out completing position of the cartridge put-on member 60B, for example. When the cartridge put-on member 60B is placed in a storing position or the pull-cut completing position, furthermore, it is maintained in an integrating (temporarily fixing) state with respect to the inner rail 72 by the following structure, for example. More specifically, as shown in a partial enlarged view of FIG. 17, each of the attaching shafts 95 and 96 in the inner rail 72 supporting the cartridge put-on member 60B is temporarily fitted in and hooked to a concave portion 92*a* formed to take an upward protruded and dented shape on an end at a downstream side in the pull-out direction A1 of each of the guiding slots 92 in each of the link members 90 and 91. Consequently, the cartridge put-on member 60B is temporarily fixed to the inner rail 72.

Description will be given to an operation for attaching a toner cartridge 50 to the cartridge attaching portion 15 having the cartridge put-on member 60B and an operation for removing the toner cartridge 50 from the cartridge attaching portion 15. Different content portions from the operations for attaching and removing the toner cartridge 50 according to the exemplary embodiment will be mainly described.

The attaching operation will be first described. First of all, as shown in FIGS. 13A and 13B, the cartridge put-on member 60B stored in a housing frame portion 16 of the cartridge attaching portion 15 is manually pulled out of a housing 10 and is then displaced from the pull-out state into a downward moving state.

Figure 14:
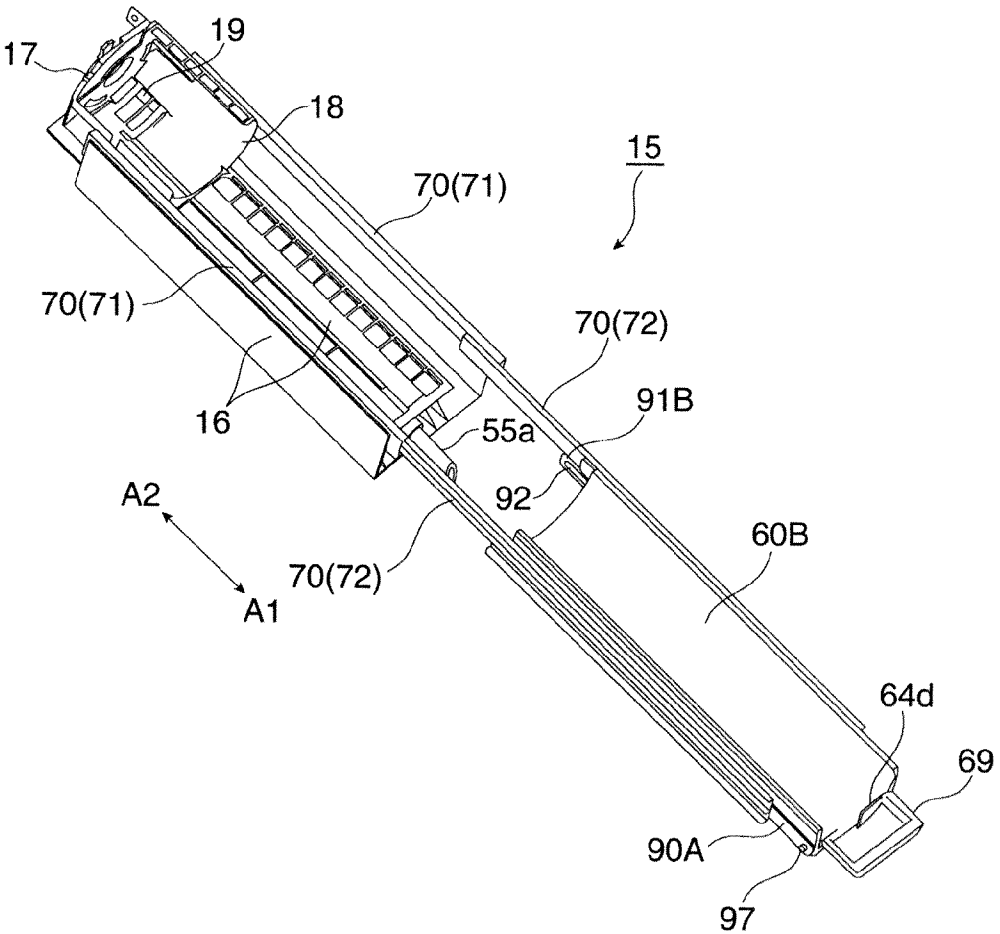
FIG. 14 is a perspective view showing a state in which the cartridge receiving table (omitted partially) in the cartridge attaching portion of FIGS. 13A and 13B is pulled out to the pull-cut completing position.
Figure 15:
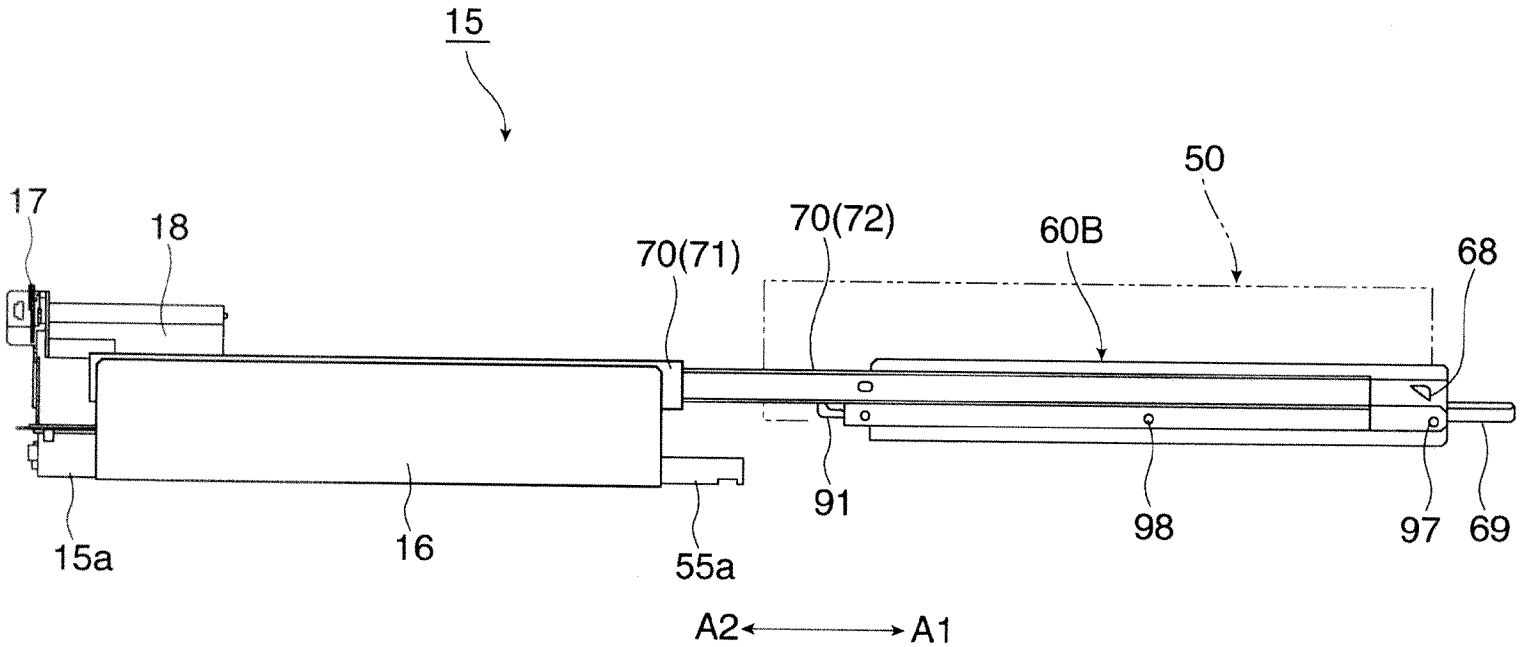
FIG. 15 is a side view showing the cartridge attaching portion in FIG. 14 (the cartridge receiving table placed in the pull-out completing position)

In this case, when the cartridge put-on member 60B is pulled out in the pull-out direction A1 with the handle 69, the inner rail 72 of the slide rail 70 is moved in the longitudinal direction of an outer rail 71 so that the cartridge put-on member 60B is moved rectilinearly, and is pulled out from the storing position to the pull-out completing position and is thus stopped (see FIGS. 13A, 14 and 15).

Next, the cartridge put-on member 60B is brought downward in the downward moving direction E1 in the pull-out completing position. In the downward moving operation, the cartridge put-on member 60B integrated with the inner rail 72 is first lifted slightly upward to release the guiding slots 92 in the link members 90 and 91 from the temporary fixing state to the attaching shafts 95 and 96 fitted in the concave portions 92*a* and is then pulled slightly in the pull-out direction A1. Consequently, the link members 90 and 91 are moved to be slid with respect to the attaching shafts 95 and 96 by a predetermined length of the guiding slots 92 and the ends of the link members 90 and 91 attached to the cartridge put-on member 60B side are then started to be moved downward in a state in which a curved track is drawn downward in an obliquely forward direction to be the downstream side in the pull-out direction A1. In particular, an end on a receiving table side of the link member 90 is set to be brought down toward the position on the downstream side in the pull-out direction A1 from the downstream end portion 72*a* to be a front end side in the pull-out direction A1 of the inner rail 72.

Subsequently, the cartridge put-on member 60B is started to be shifted in the downward moving direction E1 while it is maintained in an almost horizontal state by means of the link members 90 and 91 started to be brought down in an obliquely forward direction. Then, the cartridge put-on member 60B is brought down from the pull-out completing position to the cartridge put-on and down position by means of the link members 90 and 91 and is then held to be finally maintained wholly in an almost horizontal state (see FIGS. 13B, 16 and 17). The cartridge put-on member 60B is stopped in the cartridge put-on and down position through a collision of a part of the link members 90 and 91 with a stopping protruded portion 68 formed on the side part of the cartridge put-on member 60B as shown in FIGS. 15 to 17, for example.

The height H4 of the cartridge put-in table 60B shifted to the put-on and down position is lower by Δh than the height H2 of the pull-out completing position (see FIG. 138). Moreover, the cartridge put-on member 60B at this time is wholly maintained in an almost horizontal state (see FIGS. 13B and 17).

Consequently, a part of the position (state) in which the toner cartridge 50 is put on the cartridge put-on member 60B is lower than that in the case in which it is put on at the height H2 of the pull-out completing position, for example. Therefore, it is possible to easily put the toner cartridge 50 on the cartridge put-on member 605 without requiring lifting the whole toner cartridge 50 to an unnecessarily high position. In the put-on, furthermore, it is not necessary to bring the whole toner cartridge 50 into a tilting state.

Figure 16:
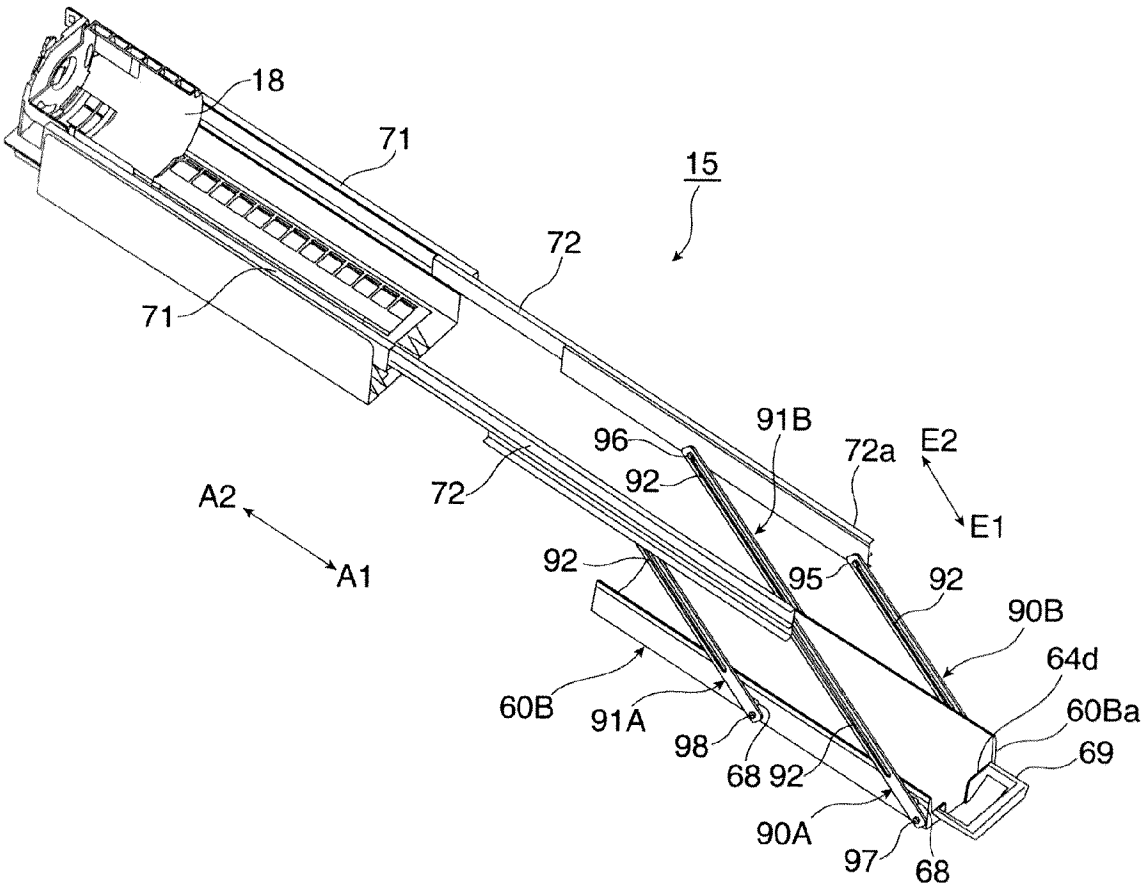
FIG. 16 is a perspective view showing a state in which the cartridge receiving table in the cartridge attaching portion of FIGS. 13A and 13B is brought down to the put-on and down completing position.
Figure 17:
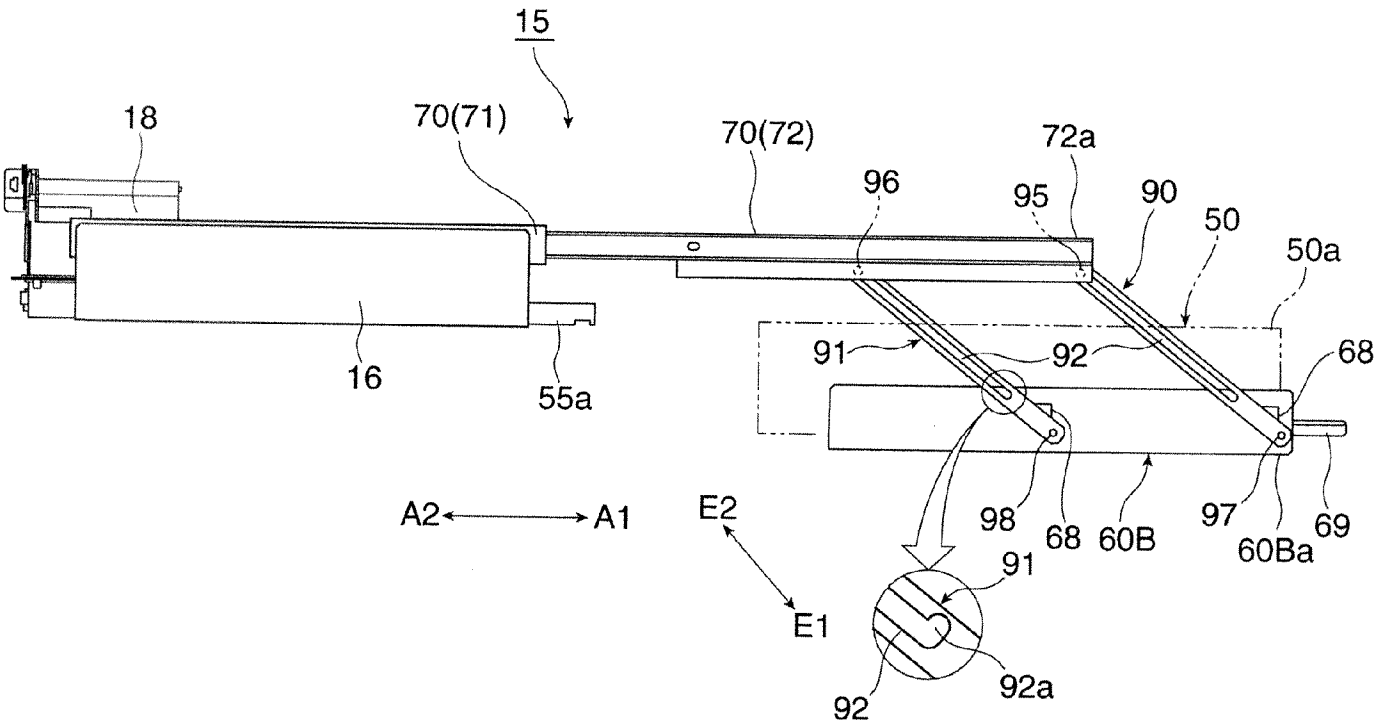
FIG. 17 is a side view showing the cartridge attaching portion in FIG. 15 (the cartridge receiving table placed in the put-on and down position)

When the cartridge put-on member 60B is shifted to the cartridge put-on and down position by means of the link members 90 and 91, moreover, the downstream end portion 72*a* in the pull-out direction A1 of the inner rail 72 in the slide rail 70 is maintained in a state in which it is not protruded from a tip portion 60Ba in the pull-out direction A1 of the cartridge put-on member 60B to the downstream side in the pull-out direction A1 as shown in FIGS. 16 and 17. When the toner cartridge 50 is put on or down from the cartridge put-on member 60B, consequently, the presence of the downstream end portion 72*a* of the inner rail 72 is not an obstacle.

The toner cartridge 50 to be attached is put on the cartridge put-on member 60B which is shifted to the cartridge put-on and down position and is set into almost the horizontal state as shown in FIGS. 16 and 17.

Subsequently, (an end 60*a* of the cartridge put-on member 60B having the toner cartridge 50 put thereon and set into almost the horizontal state is lifted upward and returned to the pull-out completing position as shown in FIGS. 13A, 14 and 15.

In this case, when the cartridge put-on member 60B is lifted in the upward moving direction E2, the link members 90 and 91 are guided to the attaching shafts 95 and 96 provided on the inner rails 72 through the slot 92 and are thus moved upward, and the tip, portion 60*a* on the downstream side in the pull-out direction A1 is lifted from the cartridge put-on and down position up to the height H2 of the pull-out completing position so that the whole cartridge put-on member 60B is finally brought into an almost horizontal state (see FIGS. 13A and 15).

Subsequently, the cartridge put-on member 60B having the toner cartridge 50 put thereon and set into a lifting state to the pull-out completing position is pushed into the housing frame portion 16 of the cartridge attaching portion 15 and is thus stored therein as shown in FIGS. 2 and 4.

By carrying cut the operating work, the toner cartridge 50 is perfectly attached to the cartridge attaching portion 15 (see FIGS. 1 and 2).

On the other hand, the operation for removing the toner cartridge 50 from the cartridge attaching portion 15 is carried out in a reverse procedure to the attaching operation.

More specifically, the cartridge put-on member 60B having the toner cartridge 50 put thereon is pulled in the pull-out direction A1 and is thus pulled out from the storing position to the pull-out completing position to be an outside of the housing 10 (see FIGS. 13A and 15). Thereafter, the cartridge put-on member 60B is moved downward in the downward moving direction E1 through the link members 90 and 91 in the pull-out completing position and is thus shifted to the cartridge put-on and down position (see FIGS. 13B and 17).

Consequently, the toner cartridge 50 to be removed is maintained to be put on the cartridge put-on member 60B which is placed in the cartridge put-on and down position and is wholly set into almost the horizontal state as shown in FIG. 17. Therefore, the toner cartridge 50 is taken out and put down from the cartridge put-on member 60B. Moreover, the toner cartridge 50 to be attached is preferably put on the cartridge put-on member 60B from which the toner cartridge 50 to be removed is put down (see FIG. 16.

Thus, the toner cartridge 50 is removed from the cartridge attaching portion 15.

Also in the removal, the cartridge put-on member 60B on which the toner cartridge 50 to be removed is put has the height H4 of the whole put-on and down position which is lower by Δh than the height H2 of the pull-out completing position (see FIG. 13B), and furthermore, is wholly maintained in almost the horizontal state (see FIGS. 13B and 17).

Consequently, the whole position (state) in which the toner cartridge 50 is put down from the cartridge put-on member 60B is lower than that in the case in which it is put on at the height H2 of the pull-out completing position, for example. Therefore, it is possible to easily put the toner cartridge 50 down from the cartridge put-on member 60B without requiring lifting the whole toner cartridge 50 to an unnecessarily high position.

When the cartridge put-on member 60B on which the toner cartridge 50 to be removed is put is shifted to the cartridge put-on and down position, moreover, the downstream end portion 72*a* in the pull-out direction A1 of the inner rail 72 in the slide rail 70 is maintained in a state in which it is not protruded from the end 60Ba on the downstream side in the pull-cut direction A1 of the cartridge put-on member 60B (and furthermore, an end 50*a* on the side where a handle portion 53 of the toner cartridge 50 put on the cartridge put-on member 60B is provided) as shown in FIG. 17. When the toner cartridge 50 is to be put down from the cartridge put-on member 60B, consequently, the presence of the downstream end portion 72*a* in the pull-out direction A1 of the inner rail 72 is not an obstacle.

FIGS. 18 to 21 show an exemplary example of a structure in which a part of the image forming apparatus 1 according to the exemplary embodiment (FIGS. 1 to 3) is deformed.

Figure 18:
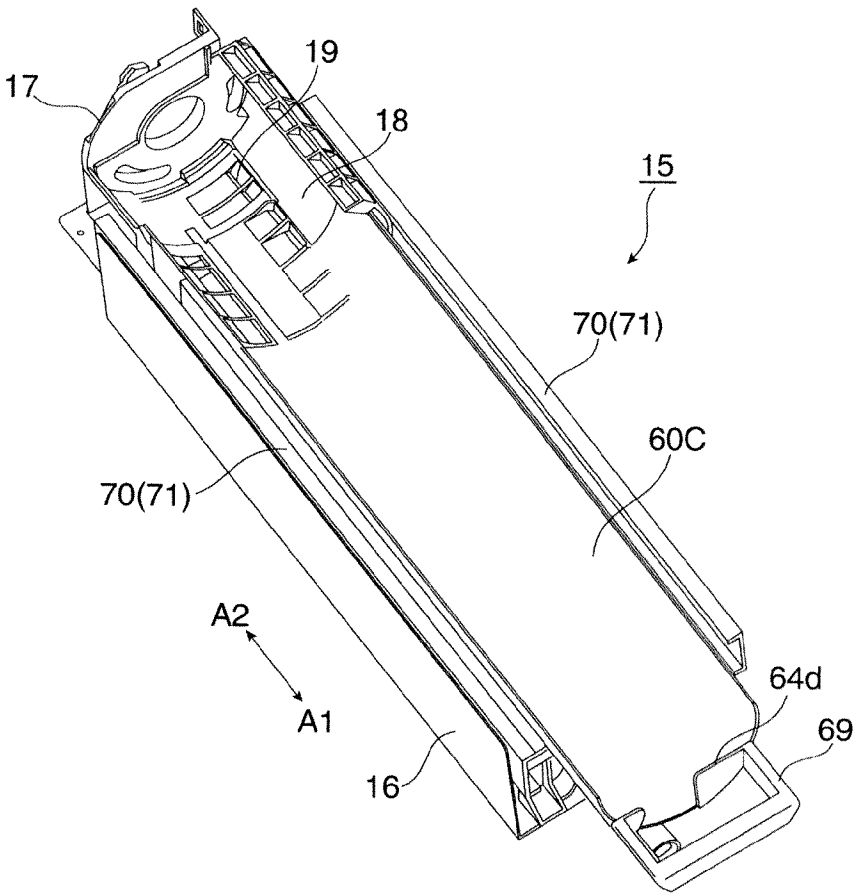
FIG. 18 is a perspective view showing another exemplary example of an attaching structure of a cartridge put-on member in the cartridge attaching portion of FIG. 4 (the cartridge put-on member is placed in a storing position)
Figure 19:
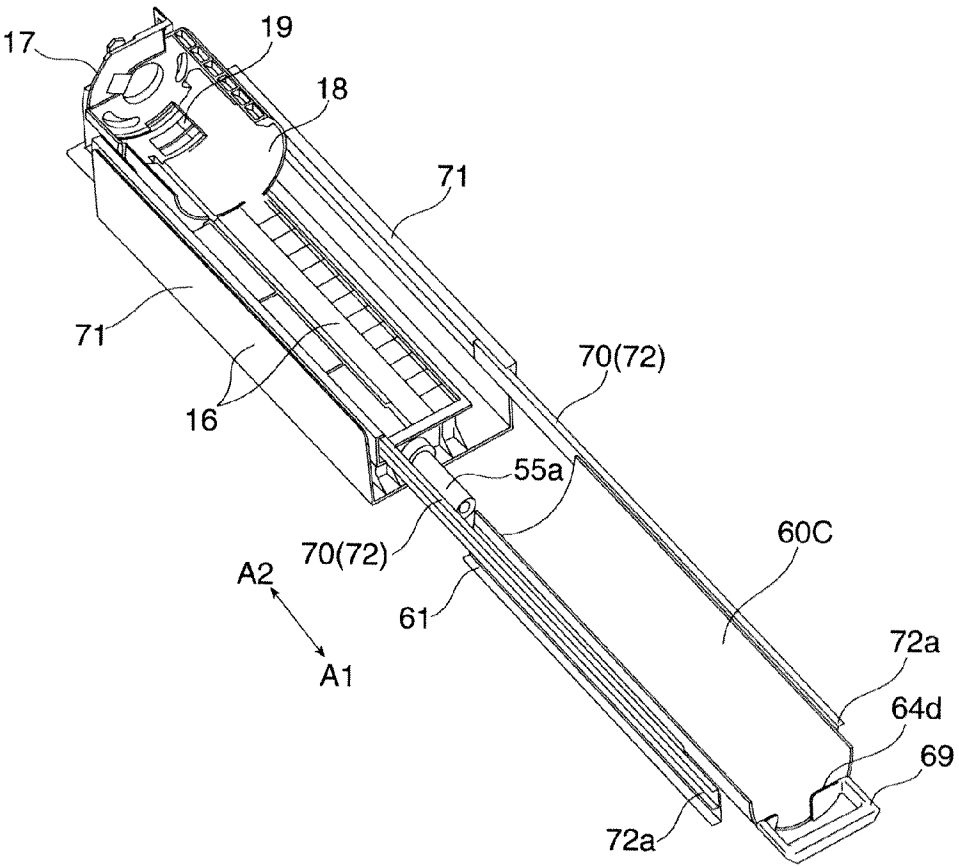
FIG. 19 is a perspective view showing a state in which the cartridge receiving table in the cartridge attaching portion of FIG. 18 is pulled out to the pull-out completing position.
Figure 20:
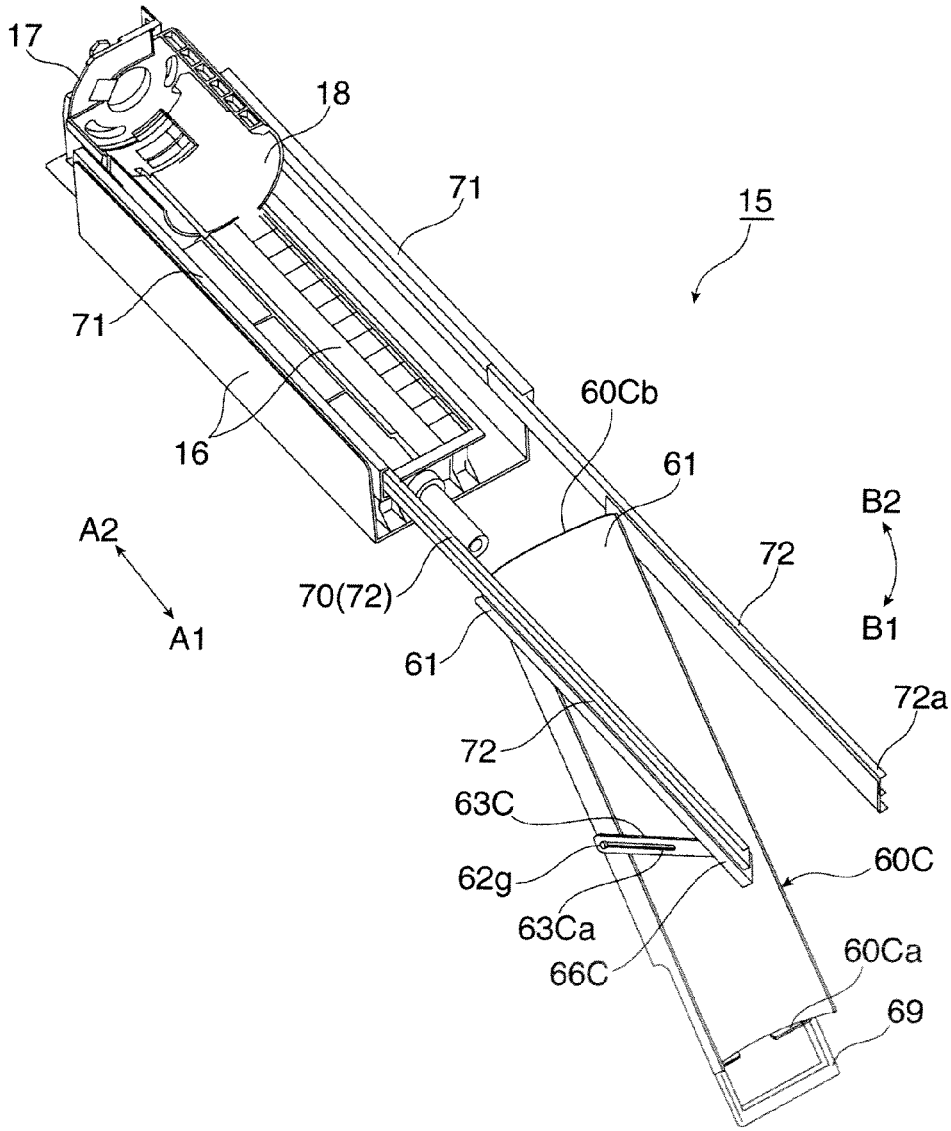
FIG. 20 is a perspective view showing a state in which the cartridge receiving table in the cartridge attaching portion of FIG. 18 is pulled out and is then brought down to the put-on and down position.

In an image forming apparatus 1 according to the exemplary embodiment, there is employed a construction in which a part of a structure for attaching a cartridge put-on member 60C to a cartridge attaching portion 15 is different. More specifically, the cartridge put-on member 60C has a basic structure in which an end 60Cb on an upstream side in a pull-out direction A1 in a side plate portion is supported through a rotating shaft 61 provided between the end 60Cb and an inner rail 72 in a slide rail 70 so that the whole end 60Cb is rocked in directions shown in arrows B1 and B2 (a downward moving direction B1 and an upward moving direction B2) around the rotating shaft 61 with respect to the slide rail 70 (the inner rail 72) as shown in FIGS. 18 to 20. However, the cartage put-on member 60C is supported by a single rock aiding arm 63C having a different attaching structure as will be described below.

As shown in FIG. 20, the rock, aiding arm 63C is a long plate member on which a guiding slot 63Ca is extended from an almost central part in a longitudinal direction thereof toward one of ends. The rock aiding arm 63C has one of ends which is attached rockably through an attaching shaft 66C provided on a downstream end portion 72*a* of the inner rail 72, and has the other end which is attached through the slot 63Ca to a support shaft 62*g* protruded from an almost central part in the pull-out direction A1 in the side plate portion of the cartridge put-on member 60C (a frame body 62). When the cartridge put-on member 60C is rocked in the downward moving direction B1, consequently, the rock aiding arm 63C supports a portion on a tip side of the cartridge put-on member 60C which is brought downward in a lifting state and regulates an amount of the downward movement (an angle for the downward movement) in a condition in which one of ends is supported on the downstream end portion 72*a* side of the inner rail 72.

Description will be given to an operation for attaching a toner cartridge 50 to the cartridge attaching portion 15 having the cartridge put-on member 60C. Different content portions from the operation for attaching the toner cartridge 50 according to the embodiment will be mainly described.

First of all, as shown in FIGS. 18 and 19, the cartridge put-on member 60C (see FIG. 18) stored in a housing frame portion 16 of the cartridge attaching portion 15 is manually pulled out of a housing 10 and is then displaced from the pull-out state into the downward moving state.

In this case, when the cartridge put-on member 60C is pulled in the pull-out direction A1 with a handle 69, the inner rail 72 of the slide rail 70 is moved in the longitudinal direction an outer rail 71 so that the cartridge put-on member 60C is moved rectilinearly, and is pulled out from the storing position to the pull-out completing position and is thus stopped (see FIGS. 3A and 19).

When the cartridge put-on member 60C is brought down in the downward moving direction B1 in the pull-out completing position, next, the whole cartridge put-on member 60C (the body frame 62) is rocked downward around the rotating shaft 61 provided on the inner rail 72, a tip portion 60Ca on the downstream side in the pull-out direction A1 is brought down from the pull-out completing position to the cartridge put-on and down position and the whole cartridge put-on member 60C is finally maintained in a tilting state (see FIGS. 3B and 20). In this case, the cartridge put-on member 60C is supported and stopped in a lifting state through the single rock aiding arm 63C.

Consequently, a part of the position (state) in which the toner cartridge 50 is put on the cartridge put-on member 60C is lower than that in the case in which it is put on at a height H2 of the pull-out completing position, for example. Therefore, it is possible to easily put the toner cartridge 50 on the cartridge put-on member 60C without requiring lifting the whole toner cartridge 50 to an unnecessarily high position.

Figure 21:
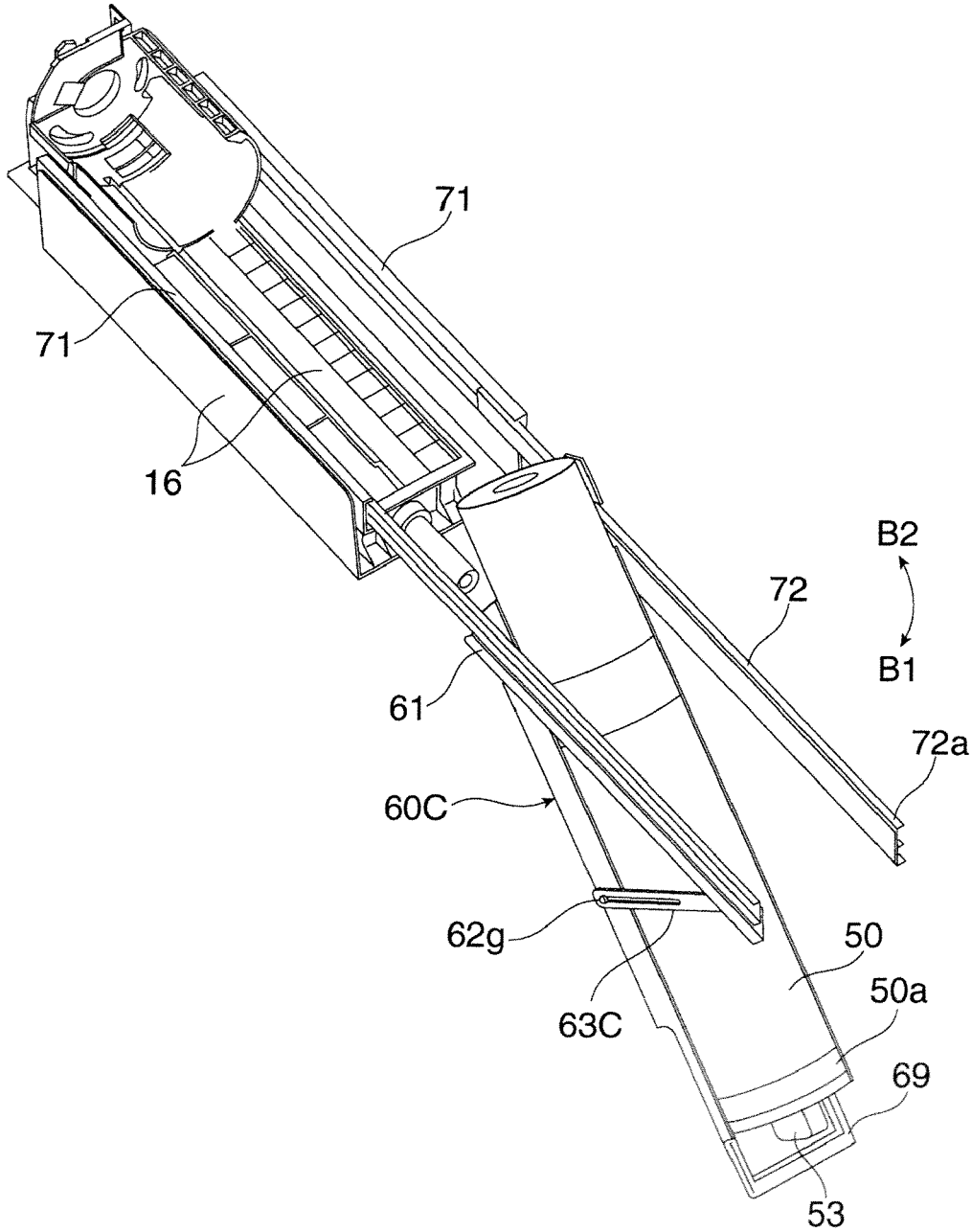
FIG. 21 is a perspective view showing a state in which the toner cartridge is put on the cartridge receiving table placed in the put-on and down position of FIG. 20.

The toner cartridge 50 to be attached is put on the cartridge put-on member 60C which is shifted to the cartridge on and down position and is set into an oblique tilting state as shown in FIG. 21.

Subsequently, (the end 60Ca of the cartridge put-on member 60C having the toner cartridge 50 put thereon and set into the tilting state is lifted upward and returned to the pull-out completing position. In this case, the cartridge put-on member 60C is rocked in the upward moving direction B2 around the rotating shaft 61 and the tip portion 60Ca on the downstream side in the pull-cut direction A1 is lifted from the cartridge put-on and down position to the height H2 of the pull-out completing position, and the whole cartridge put-on member 60C is finally brought into an almost horizontal state (see FIGS. 3A and 19).

Then, the cartridge put-on member 60C having the toner cartridge 50 put thereon and set into the lifting state to the pull-out completing position is pushed into the housing frame portion 16 of the cartridge attaching portion 15 and is thus stored therein as shown in FIGS. 2 and 18.

By carrying out the operating work, the toner cartridge 50 is perfectly attached to the cartridge attaching portion 15 (see FIGS. 1 and 2). The operation for removing the toner cartridge 50 from the cartridge attaching portion 15 is carried out in a reverse procedure to the attaching operation.

Although the description has been given to the image forming apparatus which uses a dry toner as the developer to form an image constituted by the dry toner in each of the exemplary embodiments, examples of the image forming apparatus further include a wet type image forming apparatus which uses a liquid developer (a wet toner) as a developer to form an image constituted by the liquid developer and an ink discharging type image forming apparatus which uses an ink as a developer to form an image constituted by the ink. In the case in which the image forming apparatuses are employed, it is possible to use a cartridge for accommodating a liquid developer or an ink in place of the toner cartridge 50 and to apply a structure related to the toner cartridge attaching portion 15 according to each of the exemplary embodiments to an attaching portion for attaching the cartridge.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular a use contemplated. It is intended that the scope of the invention be defined by the following claims and their equivalents.

What is claimed is:

1. An image forming apparatus, comprising:

an image forming apparatus body that includes a container attaching portion to which a developer container for containing a developer is removably attached;

a container put-on member on which the developer container is put; and a support member to which the container put-on member is attached, the support member supporting the container put-on member to perform a movement between a first position in which the container put-on member is at the container attaching portion and is thus stored and a second position in which the container put-on member is pulled out from the container attaching portion to an outside of the image forming apparatus body, wherein at the second position, at least a part of the container put-on member is displaced downward through a rotating shaft provided on the support member to a lower position than a height of the container put-on member at the second position in the direction of gravity.

2. The image forming apparatus according to claim 1, wherein a downstream end side of the container put-on member in a pull-out direction of the container put-on member is displaced to the lower position, and when the downstream end side of the container put-on member is displaced to the lower position, an end of the support member at the downstream side in the pull-out direction of the container put-on member is disposed at a position that is within a projection region which is formed by projecting the developer container put on the container put-on member in a parallel direction with the rotating shaft of the developer container.

3. The image forming apparatus according to claim 2, wherein the container put-on member is provided with a concave portion or a protruded portion which has a shape to identify whether or not a developer container is the correct developer container to be put on the container put-on member, and the correct developer container is provided with a protruded portion or a concave portion which has a shape to be fitted in the concave portion or the protruded portion of the container put-on member.

4. The image forming apparatus according to claim 3, wherein the container put-on member includes a movable member, the movable member being provided with the concave portion or the protruded portion which has a shape to identify whether or not a developer container is the correct developer container to be put on the container put-on member.

5. The image forming apparatus according to claim 4, wherein the movable member is a protecting cover.

6. The image forming apparatus according to claim 5, wherein the protecting cover covers one end of the developer container.

7. The image forming apparatus according to claim 1, wherein the rotating shaft is disposed on a downstream end side of the support member in the pull-out direction of the container put-on member.

8. The image forming apparatus according to claim 2, wherein the rotating shaft is disposed on a downstream end side of the support member in the pull-out direction of the container put-on member.

9. The image forming apparatus according to claim 1, wherein the container put-on member is provided with a concave portion or a protruded portion which has a shape to identify whether or not a developer container is the correct developer container to be put on the container put-on member, and the correct developer container is provided with a protruded portion or a concave portion which has a shape to be fitted in the concave portion or the protruded portion of the container put-on member.

10. The image forming apparatus according to claim 7, wherein the container put-on member is provided with a concave portion or a protruded portion which has a shape to identify whether or not a developer container is the correct developer container to be put on the container put-on member, and the correct developer container is provided with a protruded portion or a concave portion which has a shape to be fitted in the concave portion or the protruded portion of the container put-on member.

11. The image forming apparatus according to claim 10, wherein the container put-on member includes a movable member, the movable member being provided with the concave portion or the protruded portion which has a shape to identify whether or not a developer container is the correct developer container to be put on the container put-on member.

12. The image forming apparatus according to claim 9, wherein the container put-on member includes a movable member, the movable member being provided with the concave portion or the protruded portion which has a shape to identify whether or not a developer container is the correct developer container to be put on the container put-on member.

13. The image forming apparatus according to claim 12, wherein the movable member is a protecting cover.

14. The image forming apparatus according to claim 13, wherein the protecting cover covers one end of the developer container.

* * * * *